US006873803B2

(12) United States Patent
Yogome et al.

(10) Patent No.: US 6,873,803 B2
(45) Date of Patent: Mar. 29, 2005

(54) IMAGE FORMING APPARATUS AND METHOD OF DISPLAYING INFORMATION ABOUT IMAGE FORMING APPARATUS

(75) Inventors: Keyaki Yogome, Kyoto (JP); Hiroshi Mizuno, Ikoma (JP); Hidetoshi Miyamoto, Takatsuki (JP); Masahiko Matsuura, Suita (JP); Takaji Kurita, Osakasayama (JP)

(73) Assignee: Minolta Co., Ltd., Osaka (JP)

( * ) Notice: Subject to any disclaimer, the term of this patent is extended or adjusted under 35 U.S.C. 154(b) by 83 days.

(21) Appl. No.: 09/878,171

(22) Filed: Jun. 12, 2001

(65) Prior Publication Data

US 2002/0176719 A1 Nov. 28, 2002

(30) Foreign Application Priority Data

Jun. 12, 2000 (JP) ..... 2000-215196

(51) Int. Cl.[7] ..... G03G 15/00

(52) U.S. Cl. ..... 399/45; 399/9; 399/24; 399/31; 399/81

(58) Field of Search ..... 399/45, 154, 158, 399/389, 391, 31, 15, 8, 81, 9, 10, 11

(56) References Cited

U.S. PATENT DOCUMENTS

| | | | | |
|---|---|---|---|---|
| 4,126,854 A | | 11/1978 | Sheridon | |
| 4,143,103 A | | 3/1979 | Sheridon | |
| 4,496,237 A | * | 1/1985 | Schron | 399/81 |
| 4,583,834 A | * | 4/1986 | Seko et al. | 399/8 |
| 5,459,552 A | * | 10/1995 | Ohira | 399/1 |
| 5,515,144 A | * | 5/1996 | Miyasaka et al. | 358/452 |
| 5,848,318 A | * | 12/1998 | Okimoto | 399/8 |
| 5,850,583 A | * | 12/1998 | Song et al. | 399/24 |
| 5,866,284 A | * | 2/1999 | Vincent | 345/107 |
| 5,975,680 A | * | 11/1999 | Wen et al. | 345/107 |
| 6,009,284 A | * | 12/1999 | Weinberger et al. | 399/8 |
| 6,064,410 A | * | 5/2000 | Wen et al. | 345/107 |
| 6,362,807 B1 | * | 3/2002 | Baba et al. | 345/107 |
| 6,392,786 B1 | * | 5/2002 | Albert | 204/606 |
| 6,516,157 B1 | * | 2/2003 | Maruta et al. | 399/8 |

FOREIGN PATENT DOCUMENTS

| | | | | |
|---|---|---|---|---|
| JP | 06067141 A | * | 3/1994 | G02F/1/13 |
| JP | 06-075508 | | 3/1994 | |

* cited by examiner

*Primary Examiner*—Robert Beatty
(74) *Attorney, Agent, or Firm*—McDermott Will & Emery LLP

(57) ABSTRACT

A method of displaying information about an image forming apparatus comprising a first image forming portion for forming an image on a normal image display medium and a second image forming portion for forming an image on a reversible image display medium and capable of forming an image on the normal image display medium through the first image forming portion and of forming an image on the reversible image display medium through the second image forming portion, wherein the information about the image forming apparatus (information about the state of a predetermined item in the image forming apparatus) and (or) information about a setting state for image formation in the image forming apparatus) is displayed on a display device in the image forming apparatus and (or) a display device in an image information input apparatus transmitting image data to the image forming apparatus depending on the information, and an image forming apparatus capable of executing the method.

17 Claims, 20 Drawing Sheets

IMAGE FORMING APPARATUS AND METHOD OF DISPLAYING INFORMATION ABOUT IMAGE FORMING APPARATUS

The invention is based on the patent application No. 2000-215196 Pat. filed in Japan, the contents of which are hereby incorporated by reference.

BACKGROUND OF THE INVENTION

1. Field of the Invention

The present invention relates to an image forming apparatus, which can form images on a normal image display medium such as a normal paper sheet as well as a rewritable and reversible image display medium.

The present invention also relates to a method of displaying information about an image forming apparatus.

2. Description of the Background Art

At present, texts, graphics or the like prepared by a computer, a word processor or the like are displayed, for example, on a CRT display or the like, or are displayed by outputting them on a medium such as a paper sheet via a printer or the like.

However, the image display on the display such as a CRT display cannot achieve high resolutions as compared with images displayed, e.g., by printers on paper sheets, and can not display images with sufficiently high clearness and accuracy. Due to relatively low resolution and light emitted from the CRT or the like, an operation viewing images displayed on the CRT or the like for a long time causes fatigue in operator's eyes.

In contrast to the above, the display of texts and graphics on the image display mediums such as paper sheets can be performed with high clearness and high resolution, and therefore can be easy-on-the-eyes image display.

For the above reasons, texts, graphics and others prepared by the computer, word processor or the like are output onto mediums such as paper sheets by a printer or the like in almost every case even when it is necessary to read only temporarily the text or the like, or the texts are a draft which may be further revised.

The mediums such as paper sheets bearing images are abandoned or burnt when they are no longer required. This results in consumption of a large mount of resources. The printer or the like also consumes a large amount of consumable products or materials such toner, ink or thermal transfer sheets. For obtaining the new display mediums such as paper sheets or the like as well as toner, ink or the like, manufacturing energies and resources are required.

This is contrary to the current demand for reduction in environmental loads.

SUMMARY OF THE INVENTION

The inventors have researched and developed an image forming apparatus which can form images on normal image display mediums such as normal paper sheets as well as reversible (i.e., image-writable, image-erasable and image-rewritable) image display mediums, can satisfy current demands for reduction in environmental loads owing to image formation on the reversible image display mediums allowing rewriting and therefore repetitive use, and does not cause a substantial problem compared with the conventional image forming apparatus owing to conventional image formation on the normal image display mediums.

In such an image forming apparatus, however, an image can be formed on both a normal image display medium and a reversible image display medium and an image forming operation is therefore likely to be complicated.

It is an object of the present invention to provide a method of displaying information about the image forming apparatus for making the image forming operation easy.

Moreover, it is another object of the present invention to provide an image forming apparatus capable of executing the method of displaying information about the image forming apparatus.

The present invention provides a method of displaying information about an image forming apparatus comprising a first image forming portion for forming an image on a normal image display medium and a second image forming portion for forming an image on a reversible image display medium and capable of forming an image on the normal image display medium by the first image forming portion and of forming an image on the reversible image display medium by the second image forming portion, wherein the information about the image forming apparatus is displayed on a display device in the image forming apparatus and (or) a display device in an image information input apparatus for transmitting image data to the image forming apparatus depending on the information.

Typical examples of the information about the image forming apparatus can include at least one of information about a state for a predetermined item in the image forming apparatus and information about a setting state for image formation in the image forming apparatus.

Moreover, the present invention provides an image forming apparatus comprising:

a first image forming portion for forming an image on a normal image display medium;

a second image forming portion for forming an image on a reversible image display medium;

a detecting device for detecting a state related to the image forming apparatus;

a device for outputting information about the state related to the image forming apparatus in order to display at least part of the information about the state related to the image forming apparatus which is detected by the detecting device; and a display device for displaying a predetermined part of the information which is generated from the device for outputting the information about the state related to the image forming apparatus, wherein the device for outputting the information about the state related to the image forming apparatus can output, to an image information input apparatus transmitting image data to the image forming apparatus, a predetermined part of the information about the state related to the image forming apparatus which is generated from the outputting device in order to display the same on a display device in the image information input apparatus.

Typical examples of the state of the image forming apparatus can include a state of a predetermined item in the image forming apparatus.

Furthermore, the present invention provides an image forming apparatus comprising:

a first image forming portion for forming an image on a normal image display medium;

a second image forming portion for forming an image on a reversible image display medium;

a device for outputting information about a setting state of the image forming apparatus in order to display at least part of the information about the setting state of the image forming apparatus for image formation; and a display device for displaying a predetermined part of the information which is generated from the device for outputting the information about the setting state of the image forming apparatus, wherein the device for outputting the information about the setting state of the image forming apparatus can output, to an image information input apparatus transmitting image data to the image forming apparatus, a predetermined part of the information about the setting state of the image forming apparatus which is generated from the outputting device in order to display the same on a display device in the image information input apparatus.

An apparatus having a combination of the features of the above-mentioned two different image forming apparatuses is also related to the present invention.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 1(A) is a cross section showing an example before image display, and FIG. 1(B) is a cross section showing an example during image display;

DESCRIPTION OF THE PREFERRED EMBODIMENTS

Figure 1A:
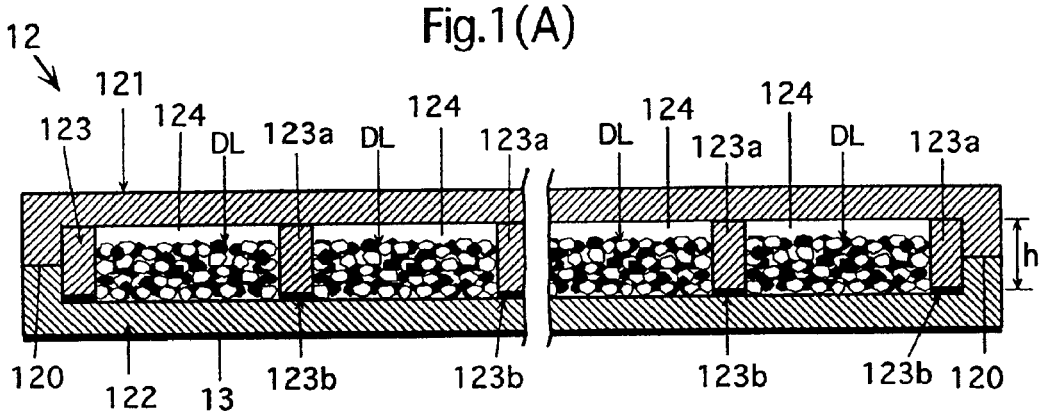
FIGS. 1(A) and 1(B) show an example of an image display medium of a dry chargeable particle containing type.

Each of methods of displaying information about an image forming apparatus according to preferred embodiments of the present invention serves to display information about an image forming apparatus comprising a first image forming portion for forming an image on a normal image display medium and a second image forming portion for forming an image on a reversible image display medium, wherein an image can be formed on the normal image display medium by means of the first image forming portion and an image can be formed on the reversible image display medium by means of the second image forming portion.

In the method of displaying information about the image forming apparatus according to a preferred embodiment of the present invention, information about a state of a predetermined item in the image forming apparatus is displayed on a display device in the image forming apparatus and (or) a display device in an image information input apparatus transmitting image data to the image forming apparatus depending on the information.

According to the method of displaying information about the image forming apparatus, all information about the state of the predetermined item are not displayed in only the image forming apparatus and are not displayed in only the image information input apparatus (a computer, a facsimile receiver, these apparatuses connected to a network and the like). The information about the state is displayed on at least one of the display device in the image forming apparatus and the display device in the image information input apparatus depending on the information about the state. Accordingly, a user can see the information on at least one of the display device in the image forming apparatus and the display device in the image information input apparatus and can take measures easily and properly. Correspondingly, an image forming operation can be carried out easily.

In some cases, the "image display medium" will be hereinafter referred to as a "medium".

In some cases, the normal image display medium such as a plain paper (paper sheet) will be referred to as a "medium PP" or "PP".

In some cases, the reversible image display medium will be referred to as a "medium TP" or "TP".

For example, the "state about a predetermined item in the image forming apparatus" can be roughly classified into:

(A1) a state of the image display medium;

(A2) a state of an image forming element (a developing device, a fixing device and the like); and (A3) an operation mode of a printer (image forming apparatus).

They can be further illustrated in the following manner, respectively.

(A1) Information About the Image Display Medium a type of a prepared medium, a state of an image forming surface in the medium, the presence of the medium, a direction of the surface and back face of the medium (a state of errors of the surface and back face), a state of errors of a medium type, a setting state of the medium type, the presence of overwrite prohibition in the medium, the presence of a medium feeding cassette, a state of a reversible image display medium (the number of uses, the degree of deterioration or the like) and the like.

(A2) A State of an Image Forming Element a set position and a developing mode of a developing device, a set position, a fixing mode and a fixing temperature of a fixing device, and a state of each of elements such as a cleaner, a transfer mechanism, a medium delivery mechanism and the like.

(A3) An Operation Mode of a Printer (Image Forming Apparatus)

a standby mode, an energy saving mode, a starting mode, a print mode, a communication mode and the like.

In the method of displaying information about an image forming apparatus according to another preferred embodiment of the present invention, information about a setting state for image formation in the image forming apparatus is displayed on a display device in the image forming apparatus and (or) a display device in an image information input apparatus transmitting image data to the image forming apparatus depending on the information.

According to the method of displaying information about the image forming apparatus, all information about the setting state for image formation in the image forming apparatus are not displayed in only the image forming apparatus and are not displayed in only the image information input apparatus (a computer, a facsimile receiver, these apparatuses connected to a network and the like). The information about the setting state is displayed on at least one of the display device in the image forming apparatus and the display device in the image information input apparatus depending on the information about the setting state. Accordingly, a user can see the information on at least one of the display device in the image forming apparatus and the display device in the image information input apparatus and can take measures easily and properly. Correspondingly, an image forming operation can be carried out easily.

For example, the "setting state of the image forming apparatus for image formation" in the method of displaying image information can be roughly classified into (B1) a setting state of a medium in the image forming apparatus and (B2) an image forming mode (print mode). Each of them will be further described as follows.

(B1) Medium Setting State

For example, the medium setting is detected by a system including the image forming apparatus or is detected through the manual medium setting input of a user.

In the former case, various medium type detecting devices can be utilized. By detecting a medium type through the medium type detecting device, a medium type to be used for image formation can also be set. In the case in which the medium type detecting device is to be utilized, a medium type prepared in the image forming apparatus which belongs to the state of the image forming apparatus and the like can also be detected.

Examples of the medium type detecting device include the following:

a) a device for detecting that a medium to be used for image formation is the normal image display medium (hereinafter referred to as a "medium PP" or "PP") such as a paper sheet or the reversible image display medium (hereinafter referred to as a "medium TP" or "TP") based on a medium display portion provided at an image display medium accommodating cassette attached to a cassette attaching portion provided in the image forming apparatus; and b) a device for detecting that a medium to be used for the image formation is the medium PP or the medium TP based on a medium display portion provided on the medium accommodated in a cassette to be attached to a cassette attaching portion provided in the image forming apparatus.

As examples of the medium display portion provided at the medium in the case of the medium detecting device of the latter b), it is possible to utilize the size of the medium, a cut, a notch, a transmission hole, a special sign or mark which are provided, e.g., on the medium TP, various physical properties such as an electrostatic capacity, a surface resistance, a conductivity, a quantity of magnetism, a spectral reflecting characteristic, a thickness, an air transmission ratio, a weight and a flexibility in the medium in order to distinguish the medium PP from the medium TP.

By detecting these medium display portions through various sensors such as an optical sensor, the medium type can be detected and set.

c) In addition, it is also possible to include a device having a test printing mechanism provided on a medium transporting path on the upstream side of the image forming portion (printing portion) of the image forming apparatus and a sensor for detecting a change in physical properties of a portion to be printed on the medium by the printing mechanism. For example, it is possible to detect the medium type by detecting the presence of a change in a color of the medium through the printing operation on the medium by the test printing mechanism.

Examples of the case in which the user inputs the medium setting manually include the case in which a medium type to be used for image formation is selected and designated by the user in a medium type selection portion provided on an operation panel of the image forming apparatus, the case in which the user operates a medium selecting mechanism provided on a cassette and accommodates a predetermined medium therein and a sensor provided in the cassette attaching portion detects the result of the operation in the selecting mechanism, thereby detecting the medium type and setting the medium to be used for the image formation and the like.

(B2) Image Forming Mode (Print Mode)

Examples of the image forming mode include a PP mode, a TP mode, a trial print mode, an editorial print mode and the like.

The PP mode indicates a mode for printing on the medium PP in which image information (image data) is optimized for the medium PP and is printed.

The TP mode indicates a mode for printing on the medium TP in which image information (image data) is optimized for the medium TP and is printed.

The trial print mode indicates a mode in which image information is printed in the TP mode by using the medium TP and is then printed again on the medium PP in the PP mode in accordance with the image data retained in an image data storage portion provided on the image forming apparatus.

The editorial print mode includes a mode in which a plurality of pages are printed into one sheet, a mode in which an image is enlarged or reduced to be printed, a mode in which an image is partially enlarged or reduced to be printed, a mode in which an image is subjected to variable power (magnification) vertically and/or horizontally and the like.

Examples of other mode setting include an erase mode, an overwrite prohibition mode, a print end mode, a forced stop mode, a forced discharge mode and the like.

The erase mode indicates a mode in which an image is erased from the medium TP having the image written thereto and white solid printing, black solid printing, optional image printing or the like may be carried out.

The overwrite prohibition mode indicates a mode in which a processing of ending the print, forcibly discharging a paper or the like is executed when overwrite prohibition information is detected by means of any device or an image has already been written.

The print end mode and the forced stop mode indicate a mode in which the print is stopped in the image forming apparatus when the print should be stopped through error detection or the like.

The forced discharge mode indicates a mode to be utilized when the medium should be forcibly discharged in printing operation due to a selection error or the like.

The information about the predetermined item in the image forming apparatus may be displayed on at least one of the display device in the image forming apparatus and the display device in the image information input apparatus depending on the information and the information about the setting state for image formation in the image forming apparatus may be displayed on at least one of the display device in the image forming apparatus and the display device in the image information input apparatus depending on the information.

In any case, in the method of displaying information about the image forming apparatus, it is also possible to display a message based on the state of the predetermined item in the image forming apparatus and (or) the setting state for image formation in the image forming apparatus in at least one of the display devices.

Examples of such a message include various alarm messages, various error information messages and other messages.

The specific examples of these messages are as follows.

<Alarm and Error Information>

A message for an alarm and error information about medium information such as a medium jam, a medium shortage, a medium error, an error in directions of both sides of the medium, the state of the medium TP and the like, a message for an alarm and error information about the state of various elements of a system such as a cleaner, a transfer mechanism, a medium transporting mechanism, a setting position and a mode of a developing device, a setting position, a mode and a fixing temperature of a fixing device and the like, a message for an alarm and error information about an operation mode of the image forming apparatus such as a standby mode, an energy saving mode, a starting mode, a print mode or a variable power (magnification) mode, and a message for an alarm and error information about various setting such as a print mode, medium setting and the like.

For the alarm and error information about the medium information, various information can be detected and displayed. For example, the medium jam may be detected through a detecting device of a general printer and may be thus displayed. It is possible to display messages for a medium type, a medium surface to be printed, a medium shortage, an error in the medium type, medium type setting, overwrite prohibition, and the presence of a medium feeding (supplying) cassette.

<Other Messages>

A message indicative of a processing method for an error, a message for confirming a processing continuation, a message for selecting a processing and the like.

Various display devices can be used.

For example, it is possible to include a display device for carrying out a display through an LED or other lamps, a liquid crystal display, a display using a sound of a buzzer or the like, a voice display, a display on the image display medium, a display on the image information input apparatus, a display by a printer driver, a display by a software and the like.

A display can be carried out on the printed medium TP in more detail because of a characteristic of the medium TP such as a high resolution or a large display area. In addition, since the medium TP is intended for a temporary display, the display on the medium TP is particularly preferable.

Examples of a display on the medium TP include the number of uses, the degree of deterioration, performance information and the like of the medium. The display can inform the user of the lifetime of the medium TP. The display may be carried out through text printing (characters, numerals or the like) or a code (bar code, a two-dimensional code or the like) may be recorded, which is optional.

The image forming apparatus according to each of preferred embodiments of the present invention comprises a first image forming portion for forming an image on a normal image display medium and a second image forming portion for forming an image on a reversible image display medium.

The image forming apparatus according to one of the preferred embodiments of the present invention comprises: a detecting device for detecting a state of a predetermined item in the image forming apparatus, a device for outputting information about the state of the image forming apparatus in order to display at least part of the information about the state of the image forming apparatus which is detected by the detecting device, and a display device for displaying a predetermined part of the information which is generated from the device for outputting the information about the state of the image forming apparatus, wherein the device for outputting the information about the state of the image forming apparatus can output, to an image information input apparatus transmitting image data to the image forming apparatus, a predetermined part of the information about the state of the image forming apparatus which is generated from the outputting device in order to display the part of the information on a display device in the image information input apparatus.

The "state of the predetermined item in the image forming apparatus" is the same as that described in the information display method.

According to the image forming apparatus, an image can be formed on either of the normal image display medium and the rewritable reversible (i.e., image-writable, image-erasable and image-rewritable) image display medium. For example, accordingly, an image which is only temporarily seen and read or may be further revised can be output and displayed on the reversible image display medium or can be output and displayed on a conventional normal image display medium if necessary. Moreover, a complete image and the like can be output and displayed on the conventional normal image display medium to be retained for a long period of time or to be presented to other people, and can be output and displayed on the reversible image display medium depending on circumstances.

Thus, the image can be output and displayed on the reversible image display medium which can be used repetitively because it is rewritable, and therefore, it is possible to satisfy a demand to reduce an environment loads such as resource saving, energy saving or the like at the present time. Moreover, the image can be displayed on the conventional normal image display medium, and therefore, the image forming apparatus has no special obstacle as compared with the conventional image forming apparatus.

According to the image forming apparatus, the information generated from the device for outputting the information about the state of the image forming apparatus can be displayed on at least one of the display device in the image forming apparatus and the display device in the image information input apparatus transmitting image data depending on the information. Accordingly, the user can see the display and take countermeasures easily and properly. Correspondingly, the image forming operation can be carried out easily.

An image forming apparatus according to another preferred embodiment of the present invention comprises:

a device for outputting information about a setting state of the image forming apparatus in order to display at least part of the information about the setting state of the image forming apparatus for image formation; and a display device for displaying a predetermined part of the information which is generated from the device for outputting the information about the setting state of the image forming apparatus, wherein the device for outputting the information about the setting state of the image forming apparatus can output, to an image information input apparatus transmitting image data to the image forming apparatus, a predetermined part of the information about the setting state of the image forming apparatus which is generated from the outputting device in order to display the part of the information on a display device in the image information input apparatus.

The "setting state of the image forming apparatus for image formation" is the same as that described in the information display method.

According to the image forming apparatus, the information generated from the device for outputting the information about the setting state of the image forming apparatus can be displayed on at least one of the display device in the image forming apparatus and the display device in the image information input apparatus transmitting image data depending on the information. Accordingly, the user can see the display and take countermeasures easily and properly. Correspondingly, the image forming operation can be carried out easily.

The following image forming apparatus may be used. More specifically, the image forming apparatus comprises:

a detecting device for detecting a state of a predetermined item in the image forming apparatus;

a device for outputting information about a state of the image forming apparatus in order to display at least part of the information about the state of the predetermined item in the image forming apparatus which is detected by the detecting device;

a device for outputting information about a setting state of the image forming apparatus in order to display at least part of the information about the setting state of the image forming apparatus for image formation; and a display device for displaying a predetermined part of the informations generated from the device for outputting the information about the state of the image forming apparatus and the device for outputting the information about the setting state of the image forming apparatus, wherein the device for outputting the information about the state of the image forming apparatus and the device for outputting the information about the setting state of the image forming apparatus can output, to an image information input apparatus transmitting image data to the image forming apparatus, a predetermined part of the informations which are generated from the outputting devices in order to display the part of the information on a display device in the image information input apparatus.

In any case, the image forming apparatus may comprises a message output device for displaying, on at least one of the display devices, a massage based on the state of the image forming apparatus which is detected by the detecting device and (or) the setting state of the image forming apparatus.

Such a "message" is the same as that described in the information display method.

Similarly, the "display device" related to the image forming apparatus is the same as that described in the information display method.

While various information can be displayed by a variety of display devices as described above, the information and the display device do not need to be single but a plurality of information may be displayed on a plurality of display devices.

The specific examples of the display will be collectively shown in the following table, although not restricted thereto.

TABLE 1

| Operation instruction | content of detection | content of display |
|---|---|---|
| — | PP is present in cassette for TP | Medium feeding cassette is set by mistake. |
| Print in TP | Normal | Print in TP |
| Print in TP | Print mode of PP | Print in TP |
| Print in TP | standby mode | Print in TP |
| Print in TP | | Print in TP |
| print in PP | Normal | Print in PP |
| Print in TP | Medium type of PP | Medium is different. |
| Print in TP | Medium type of PP | Medium is different and print cannot be carried out. |
| Print in TP | TP printing surface having a back side out. | Back face is set. |
| print in PP | PP is not present and TP is present. | PP is out present. Print in TP? |
| Print in TP | Overwrite prohibition display on TP | Medium is prohibited from being overwritten. Overwrite? |
| Print in TP | Overwrite prohibition display on TP | Medium is prohibited from being overwritten. |
| Print in TP | TP is deteriorated. | Medium is deteriorated. |
| Print in TP | TP is deteriorated. | Medium is deteriorated. Print? |
| Print in TP | No lifetime of TP. Print cannot be carried out. | Medium has no lifetime. |
| Print in TP | No lifetime of TP. Print cannot be carried out. | Medium cannot be printed |
| print in PP | PP feeding portion has a paper jam and TP feeding portion is normal. | PP feeding portion has a paper jam. Print in TP? |
| print in PP | PP is not present. | No medium |
| print in PP | PP is not present. | Supply mediums. |
| print in PP | Medium type of TP. | Medium is different. |
| print in PP | Medium type of TP. | Medium is different and cannot be carried out. |
| print in PP | Medium type of TP. | Medium is different. Print in TP? |
| Print in TP | Fixing device has a high temperature. | Fixing device has a high temperature. Print in PP? |
| Print in TP | Fixing device has a high temperature. | Fixing device has a high temperature. Please wait for a while. |
| Print in TP | Fixing device has a high terperature. | Print cannot be carried out. |
| print in PP | Developing device is set in retreat and inoperative state. | Developing device has a trouble. |
| print in PP | Developing device is set in retreat and inoperative state. | Developing device is maintained in TP mode. Print in TP? |

The first image forming portion for forming the image on the normal image display medium may be of an indirect recording type or a direct recording type.

As a typical example, the image forming portion of the indirect recording type may be of an electrophotographic type configured to form the image by forming an electrostatic latent image corresponding to the image to be displayed on an electrostatic latent image carrier, developing the electrostatic latent image into a toner image and transferring the toner image onto the normal image display medium for fixing the same.

The image forming portion of the direct recording type may be of an ink-jet type configured to form an image by ejecting ink onto the image display medium in accordance with the image to be formed, may be of a sublimation transfer type configured to form the image by thermally transferring ink from a transfer film carrying sublimation ink onto the image display medium in accordance with the image to be formed, or may be of a thermal transfer type configured to form the image by thermally transferring thermal ink applied over transfer film onto the image display medium in accordance with the image to be formed.

The normal image display medium may be a normal paper sheet, an overhead projector sheet or the like as already described, and an appropriate image display medium can be from among them in accordance with the method of forming the image on the normal image display medium by the first image forming portion.

For example, the second image forming portion may be configured:

to display the image on the reversible image display medium of the electric field drive type by an electric field corresponding to the image to be formed, or to display the image on the reversible image display medium of the magnetic drive type by a magnetic field corresponding to the image to be formed.

The reversible image display mediums of the electric field drive type and the magnetic drive type will be described later. The image forming portion for the reversible image display medium will also be described later.

When using the reversible image display medium of the electric field drive type containing magnetic developer particles, the second image forming portion may be provided with a device for magnetically stirring dry developer particles for forming the image on the reversible image display medium by an electric field.

The reversible image display medium of the electric field drive type as described above may be an image display medium of a dry chargeable particle containing type, an electrophoresis type, a twist ball type or the like. These will now be described.

<Image Display Medium of Dry Chargeable Particle Containing Type>

A reversible image display medium includes dry developer particles contained in developer containing cell(s), which is(are) formed between two substrates (at least one having light transparency) opposed to each other with a predetermined gap therebetween. The dry developer contains two kinds of frictionally chargeable dry developer particles having different chargeable polarities and having different optical reflection densities (in other words, providing "different degrees of contrast" or "different colors").

According to the image display medium, an electric field corresponding to the image to be displayed is applied while at least two kinds of dry developer particles are frictionally charged to different polarities, respectively, and thereby the developer particles charged to the respective polarities move in the opposite directions depending on the direction of the electric field within the medium so that an image having contrast is displayed.

The medium of dry chargeable particle containing type may also be as follows:

This reversible image display medium also includes dry developer contained in developer containing cell(s), which is(are) formed between two substrates (at least one having light transparency) opposed to each other with a predetermined gap therebetween. The dry developer contains two kinds of frictionally chargeable dry developer particles having different chargeable polarities and having different optical reflection densities (in other words, providing "different degrees of contrast" or "different colors"). At least one kind of the developer particles are magnetic particles.

On this image display medium, the image can be displayed similarly to the foregoing image display medium of the dry chargeable particle containing type. Since at least one kind of the developer particles forming the dry developer are magnetic particles, the developer (developer particles) can be stirred with a magnetic field such as an oscillating magnetic field. This stirring of the developer promotes the movement of the developer particles in the operations of initialization of the medium, erasing (a kind of initialization) of the last image prior to the image formation (image display) and displaying the image in the electric field (electrostatic field) for image display. These can improve the image display.

When using the reversible image display medium of the dry chargeable particle containing type employing the foregoing magnetic particles, the image forming portion for forming the image thereon may be provided with a device for magnetically stirring the dry developer particles when forming the image by the electric field on the reversible image display medium.

The developer particles contained in the cell(s) may have a particle diameter in a range from about 1 $\mu$m to about 100 $\mu$m. The developer particles may be fine particles having such a structure that various kinds of coloring agent, charge control agent and others are dispersed in the binder resin. A third component (particles) such as a fluidity improving agent may be added and mixed.

<Image Display Medium of Electrophoresis Type>

In this medium, a closed space is formed between two substrates opposed to each other with a spacer therebetween, and is filled with display liquid formed of particles having electrophoretic mobility and a dispersion medium having a color different from that of the particles and containing the particles in a dispersed fashion. The image is displayed in the color of the particles or the dispersion medium by applying the electric field corresponding to the image to be displayed and thereby moving the particles in the display liquid.

The display liquid is generally formed of dispersion medium containing isoparaffin or the like, particles of, e.g., titanium dioxide, dye for providing contrast in color with respect to the particles, a dispersion agent such as a surface active agent and additives such as a charge applying agent.

<Image Display Medium of Twist Ball Type>

A typical example is a medium known as gyricon-base electronic paper display. This medium usually has a sheet-like form, and is disclosed in U.S. Pat. Nos. 4,126,854 and 4,143,103, although not restricted thereto. In the medium of twist ball type, two-color spherical members each having an outer surface formed of halves, which are different in color (e.g., white on one of the semi-spherical surfaces, and another color (e.g., black) on the other), are surrounded by liquid, wax or the like, and the spherical members thus surrounded fill cavities in an insulating property holding medium. By applying an external electric field corresponding to the image, the spherical members rotate within the cavities in accordance with their electrical anisotropy so that the image is displayed. The medium may be configured such that the image can be displayed by heating it to a temperature higher than the melting point of wax surrounding the spherical members and by applying an external electric field, and the image can be fixed by cooling it to a temperature not exceeding the wax melting point.

<Reversible Image Display Medium of Magnetic Drive Type>

The following reversible image display mediums of the magnetic drive type can be used depending on the structure of the image forming portion.

(a) An image display medium, in which dispersion liquid containing magnetic particles dispersed therein is held in cell(s) formed between two substrates opposed to each other with a predetermined gap therebetween, and the magnetic particles have an optical reflection density different from that of the dispersion liquid.

(b) An image display medium, in which a coating layer of micro-capsules filled with dispersion liquid containing magnetic particles dispersed therein is formed on one side of a substrate, and the magnetic particles in the micro-capsules have an optical reflection density different from that of the dispersion liquid.

Rewritable (reversible) image displays other than the above described reversible image display mediums can be used.

From the viewpoint of the drive type, the reversible image display may be of a matrix drive type having electrodes (e.g., individual electrodes for the respective pixels). In this case, a controller for applying a signal to the electrodes may be employed. The display may have an image storing property for storing and holding the written image even after stop of the application of the voltage to the electrode.

From the viewpoint of the medium used for display, the reversible image display may be a panel display such as a liquid crystal display or an electro-luminescence display.

Any one of these reversible image display mediums (or reversible image displays) allows image displaying (image-writing), image-erasing and image rewriting by selecting an electric field or a magnetic field applied thereto, and therefore allows repetitive use. Accordingly, it is not necessary to abandon them. The external supply or addition of the developer is not required. Owing to these facts, it is possible to reduce remarkably the use of the image display medium such as paper sheets as well as consumable materials such as conventional developer particles, ink or the like.

The following image forming portions for the reversible image display mediums of the electric field drive type and the magnetic field drive type can be employed.

<Image Forming Portion for Reversible Image Display Medium of Electric Field Drive Type>

On the reversible image display medium of the electric field drive type, the image can be formed by applying the electric field (electrostatic field), which corresponds to the image to be formed, on the medium. Accordingly, the image forming portion for forming such an electric field (electrostatic field) can be configured to utilize an electrostatic latent image or to utilize a write electrode.

Image Forming Portion Utilizing Electrostatic Latent Image

This image forming portion is configured such that an electrostatic latent image corresponding to the image to be displayed is formed on one (e.g., the substrate on the image observation side) of the two substrates of the medium, or an externally formed electrostatic latent image is brought closer to the medium so that the electrostatic field is formed based on the electrostatic latent image.

The formation of the electrostatic field described above may be performed simultaneously with or after formation of the electrostatic latent image. The electrostatic field may be formed by applying a predetermined potential for formation of the electrostatic field on the substrate opposite to the substrate, on which the electrostatic latent image is to be formed or brought closer. Setting of the predetermined potential can be performed, e.g., by applying a bias to an opposite electrode, which is formed on in advance or is in contact with the opposite substrate, or by grounding the opposite electrode.

The electrostatic latent image may be formed directly on the medium surface (substrate surface), e.g., by a device for directly forming electrostatic latent image, or may be formed by transferring an external electrostatic latent image formed outside the medium by an external electrostatic latent image forming device on the medium surface (substrate surface). The external electrostatic latent image may be brought closer to the medium surface.

The direct electrostatic latent image forming device may be of various discharging types, which are configured to place electrostatic latent image charges by effecting discharging on the medium surface in accordance with the image to be displayed, and also may be of various charge supplying types, which are configured to place electrostatic latent image charges by injecting charges into the medium surface in accordance with the image to be displayed. As examples of the former, a device of an ion-flow type and a device of a multi-stylus type can be employed. The device of the multi-stylus type has an electrostatic record head, in which recording electrodes are arranged in a predetermined direction (e.g., in a main scanning direction for scanning the substrate with the device). As an example of the latter device, a device of a multi-stylus type can be employed, which has an electrostatic recording head, in which recording electrodes are arranged in a predetermined direction (e.g., in a main scanning direction for scanning the substrate with the device), and neighboring control electrodes neighbor to the recording electrodes.

The external electrostatic latent image forming device may be of such a type that an electrostatic latent image corresponding to the image to be displayed is formed on an electrostatic latent image carrier, and the electrostatic latent image on the electrostatic latent image carrier is transferred onto or brought closer to the surface of the medium substrate. More specifically, the electrostatic latent image corresponding to the image to be formed is formed, e.g., on a photoconductive member such as a photosensitive member, and the electrostatic latent image on the photoconductive member is transferred onto or brought closer to the surface of the medium substrate. Alternatively, the electrostatic latent image corresponding to the image to be formed may be formed on a dielectric member, and the electrostatic latent image on the dielectric member may be transferred onto or brought closer to the surface of the medium substrate.

The above external electrostatic latent image forming devices, and particularly the device of forming the electrostatic latent image on the photoconductive member such as a photosensitive member can achieve such an advantage that the photoconductive member and others can be formed of common parts if the image forming portion for the normal image display medium is of the electrophotographic type and employs the photoconductive member such as a photosensitive member.

Image Forming Portion Utilizing Write Electrode

The image forming portion has an image write electrode arranged in contact with or close to the substrate of the image display medium, and applies a bias corresponding to the image to be displayed to the electrode.

For example, the image forming portion may have individual electrodes for respective pixels arranged in contact with or close to one (e.g., the substrate on the image observation side) of the substrates of the image display medium, and opposite electrodes arranged in contact with or close to the other substrate, and may be configured to apply a bias corresponding to the image to be displayed to each of the individual electrodes.

<Image Forming Portion for Reversible Image Display Medium of Magnetic Drive Type>

This image forming portion may have a magnetic head for image writing.

In either of the case where the image forming portion forms the image on the reversible image display medium of the electric field drive type and the case where it forms the image on the reversible image display medium of the magnetic drive type, an image erasing device may be employed for initializing the medium, or performing, as a kind of initialization, erasing of the last displayed image before the image display. A developer stirring device may be employed for initializing the medium, erasing the last displayed image before the image display, or improving the flowability of the developer particles (particularly, improving the flowability of the developer particles in the medium in the case of the dry chargeable particle containing type) for image display. Both the image erasing device and the developer stirring device may be employed.

The image erasing device may be, e.g., an erase electric field forming device for forming an electric field moving the developer particles forming the developer in the image display medium, a stirring device for applying a stirring force to the developer or a device including both of these devices. Application of the stirring force can be performed, e.g., by forming an alternating electric field with respect to the developer, forming an oscillating magnetic field, emitting ultrasonic waves, applying mechanical vibrations or a combination of two or more of them.

The erase electric field forming device may be a device for forming the electric field such that one of the two kinds of developer particles of the same optical reflection density (in other words, the same degree of contrast or the same color) are collected toward one of the substrates, and the other kind of developer particles of the same optical reflection density are collected toward the other substrate. According to this device, initialization of the medium as well as the image erasing can be performed, and further movement of the developer particles is required only in the image portion when forming a new image so that the image display can be performed smoothly and reliably with a high quality.

The erase electric field forming device may include a pair of electrodes or dielectric members arranged on the opposite sides of the reversible image display medium as well as a power supply device for applying a bias voltage thereto.

In addition to the above, the erase electric field forming device may be an electric field forming device of the discharging type for forming an electric field by performing discharging to the image display medium, or an electric field forming device of a charge injecting type for forming the electric field by injecting charges into the image display medium. A corona charging device, an electric field forming device of an ion-flow type and an electric field forming device of a multi-stylus type having a head, in which electrodes are arranged in a predetermined direction, are examples of the former. An electric field forming device of a multi-stylus type having a head, in which electrodes are arranged in a predetermined direction, and neighboring control electrodes are arranged adjacently to the above electrodes, is an example of the latter.

The stirring device may have the following structure.

(1) Device of Forming Alternating Electric Field for Reversible Image Display Medium This device can be utilized in the case where at least one kind of developer particles has an insulating property.

(2) Device of Forming Oscillating Magnetic Field for Reversible Image Display Medium This device can be utilized in the case where at least one kind of the developer particles contain magnetic members.

(3) Device of Emitting Ultrasonic Waves to Reversible Image Display Medium (4) Device of Applying Mechanical Vibrations to Reversible Image Display Medium (5) Device formed of a combination of two or more of the above devices.

Among them, the alternating electric field forming device and the oscillating magnetic field forming device are especially effective.

In the image forming apparatus, the first image forming portion for the normal image display medium and the second image forming portion for the reversible image display medium may be independent of each other, or may be partially common to each other. However, the heads for writing the image on the image display medium may be preferably independent of each other for each control of the heads.

Examples of the image forming apparatus and the method of displaying information relating to the image forming apparatus will now be described with reference to the drawings.

First, description will be given on the reversible image display medium.

<Reversible Image Display Medium of Dry Chargeable Particle Containing Type>

Figure 1B:
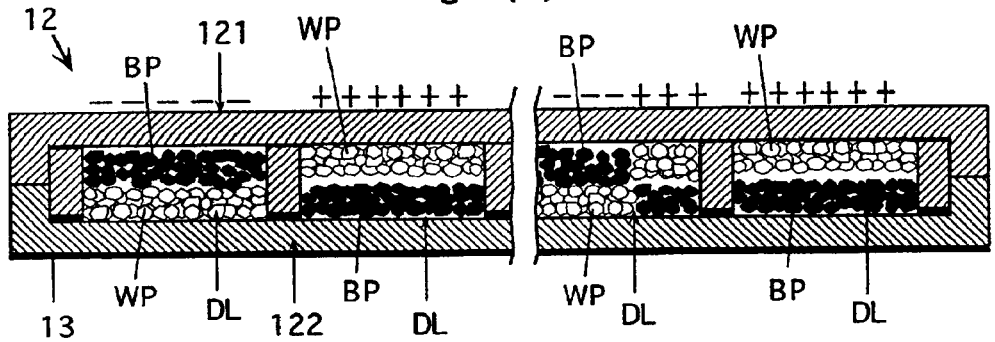
Figure 2:
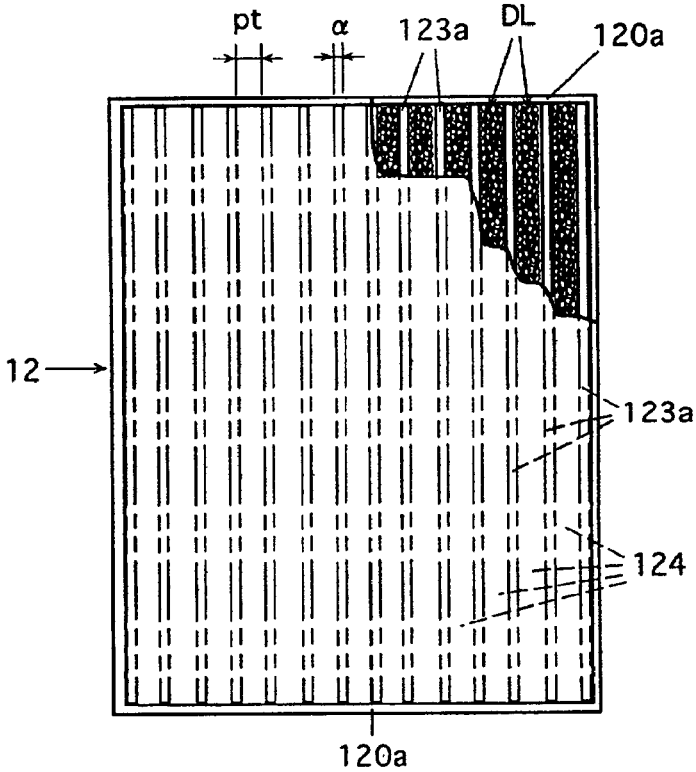
FIG. 2 is a plan showing the image display medium shown in FIG. 1(A) with a certain part cut away.

FIGS. 1(A), 1(B) and 2 show an example of a reversible image display medium of the dry chargeable particle containing type. FIG. 1(A) is a cross section of a reversible image display medium 12 before image display, and FIG. 1(B) is a cross section showing an example during the image display. FIG. 2 is a plan showing the medium 12 with a certain part cut away.

The image display medium 12 shown in these figures has a rectangular configuration, and includes first and second substrates 121 and 122 as well as a partition 123 located between these substrates. The first substrate 121 and the partition 123 are integral with each other, and are formed by thermal molding of transparent polyethylene terephthalate (PET). The second substrate 122 is also made of transparent PET, and has an outer surface coated with a vapor-deposited aluminum layer 13.

The partition 123 is formed of a plurality of longitudinal wall portions 123*a*, which are parallel to the longer side of the medium 12, and a developer accommodating cell 124 is formed by the neighboring wall portions 123*a*. Each cell 124 accommodates developer DL containing white and black developer particles WP and BP, which are mutually and frictionally charged.

The medium 12 is provided at its periphery with a thermally sealed portion 120 formed between the substrates 121 and 122. The seal portion 120 has portions 120*a*, which continue to the opposite ends of the longitudinal wall portions 123*a* and closes the opposite ends of the cells. These portions 120*a* also serve as partitions defining the cells 124.

Each cell is sealed so that developer DL does not leak from the cell.

The partition 123 (wall portions 123*a*) serves also as a spacer keeping a predetermined gap between the substrates 121 and 122.

The substrate 121 has an average thickness of 25 μm, and the substrate 122 likewise has a thickness of 25 μm. Each wall portion 123*a* has a width α of 20 μm and a height h of 100 μm, and is spaced from the neighboring wall portion by a distance pt of 200 μm. The developer DL is arranged within each cell 124 to fill 90% of its height before bonding the substrates together, and then a thin layer of photo-setting adhesive 123*b* is applied over top surfaces of the longitudinal walls 123*a* on the substrate 121. The substrate 122 is closely attached thereto, and ultraviolet light is emitted for curing the adhesive. Further, the peripheries of the substrates are thermally sealed.

The developer particles and the developer in the cell are specifically as follows.

White Developer Particles WP

Thermoplastic polyester resin (softening point=121° C., glass transition point=67° C.) in an amount of 100 parts by weight, titanium oxide (manufactured by Ishihara Sangyo Co., Ltd., CR-50) in an amount of 40 parts by weight, and salicylic acid-zinc complex (minus-charge-controlling agent Bontron E-84, manufactured by Orient Chemical Co., Ltd.,) in an amount of 5 parts by weight were fully mixed by a Henschel mixer. The mixture thus prepared was kneaded by a 2-shaft extruder/kneader, and thereafter was cooled. Thereafter, the mixture was roughly pulverized, and then was finely pulverized by a jet mill. The resulting powder was classified with wind to produce white fine-grained powder having a volume average particle diameter of 10.1 μm. Thereafter, 0.3 parts by weight of hydrophobic silica particles (Nihon Aerosil Co., Ltd.: Aerosil R-972) is added to the above powder, and the mixing and kneading are performed by a Henschel mixer to produce the white developer particles WP.

Black Developer Particles BP

Styrene-n-butyl-methacrylate resin (softening point=132° C., glass transition point=65° C.) in an amount of 100 weight parts, carbon black (Lion Oil & Fat Co., LTD., Kechenblack EC) in an amount of 4 parts by weight, silica (Nihon Aerosil Co., Ltd.: #200) in an amount of 1.5 parts by weight and magnetite-containing magnetic powder (manufactured by Titan Kogyo Co., LTD., RB-BL) in an amount of 500 parts by weight were fully mixed by a Henschel mixer, and then were kneaded by a kneader and then cooled.

Thereafter, the mixture was roughly pulverized by a feather mill, and then was finely pulverized by a jet mill. The resulting powder was classified with wind to produce black particles BP having a volume average particle diameter of 25 μm.

Developer DL

The white particles WP and the black particles BP were put into a polyethylene bottle at a rate of 12 grams of the white particles and 88 grams of the black particles. The bottle was rotated by a ball mill pedestal to knead and mix the contents for 30 minutes so that the developer DL was obtained. The white particles were charged negatively, and the black particles were charged positively. The developer thus prepared was used.

The above medium 12 used in the embodiments will be referred to as "medium TP1" hereinafter.

<Reversible Image Display Medium of Electrophoresis Type>

Figure 3:
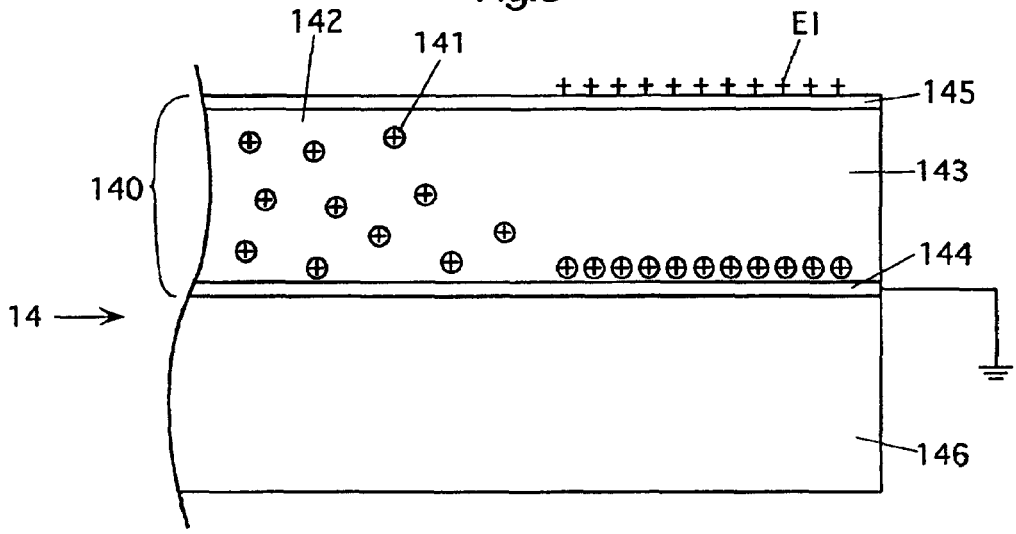
FIG. 3 shows an example of a structure of an image display medium of an electrophoresis type.

FIG. 3 shows an example of a structure of a reversible image display medium 14 of an electrophoresis type.

The medium 14 shown in FIG. 3 includes an electric field coloring layer 140 carried on a transparent carrier substrate 146. The electric field coloring layer 140 is formed of developer liquid 143, which includes charged and colored particles 141 dispersed in insulating liquid 142, and is sealingly held between a transparent conductive layer 144 and an insulating layer 145. The insulating liquid 142 is a mixture of high-purity petroleum (e.g., Isoper manufactured by Exxon Chemical Co., LTD.) as well as an ionic surface active agent and dyes. The organic particles 141 are mixed in the liquid 142 to complete the developer 143. The ionic surface active agent is adhered onto the organic colored particles 141 containing the pigment so that the particles are charged electrochemically stably. The charged and colored particles 141 are dispersed in the liquid 142 to exhibit an electrophoretic mobility.

When an electric field is not applied to the medium 14, or an electric field opposite to the predetermined electric field is applied to the medium 14, the dyes in the insulating liquid 142 can be externally viewed. When the electrostatic latent image is written, the charged and colored particles 141 move toward the transparent conductive layer 144 so that the colored particles can be externally viewed.

The image is displayed on the medium 14 by forming the electrostatic field corresponding to the image to be displayed with respect to the charged developer particles (charged and colored particles in this example) 141 dispersed in the insulating liquid 142.

<Reversible Image Display Medium of Twist Ball Type>

Figure 4:
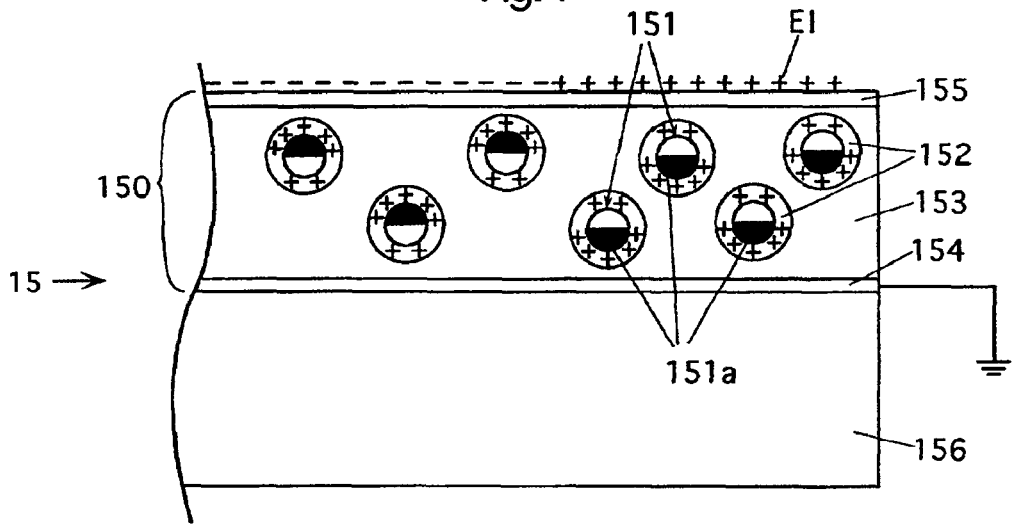
FIG. 4 shows an example of a structure of an image display medium of a twist ball type.

FIG. 4 shows an example of a structure of a reversible image display medium 15 of the twist ball type.

The medium 15 shown in FIG. 4 has an electric field coloring layer 150 carried on a transparent carrier substrate 156. The electric field coloring layer 150 includes one-side colored balls 151 each having a colored portion 151*a* on one side. The balls 151 are surrounded by insulating liquid 152, and are buried together with the liquid 152 in an insulation holding medium material 153. A transparent conductive layer 154 and an insulating layer 155 are formed on the opposite sides of the medium material 153, respectively.

The one-side colored ball 151 is prepared, e.g., in such a manner that white balls of glass primarily made of $TiO_2$ are uniformly arranged on an appropriate table, and chrome or the like is vapor-deposited thereto. The ball 151 may have a size from 30 $\mu$m to 100 $\mu$m. If it is equal to or smaller than 10 $\mu$m, the resolution of the image is further improved.

The one-side colored balls 151 are dispersed in the insulation holding medium material 153 such as elastomer, and the medium material 153 is swelled by immersing it in a solution prepared by dissolving an ionic surface active agent in organic solvent such as toluene. Thereby, the insulating liquid 152 is kept around the one-side colored ball 151. In this manner, the one-side colored ball 151 is surrounded by the insulating liquid layer 152, and is rotatably buried together with the liquid in the insulation holding medium material 153.

The one-side colored ball 151 has one and the other halves, which are different in properties, and therefore are different in amount of absorbable ions. By applying the electric field to the medium 15, the direction of the colored and uncolored surfaces of the one-side colored particle 151 changes depending on the direction of the electric field. Accordingly, the image is displayed by selectively and externally exhibiting the colored and uncolored surfaces of the one-side colored ball 151.

<Reversible Image Display Medium of Magnetic Drive Type>

Figure 5:
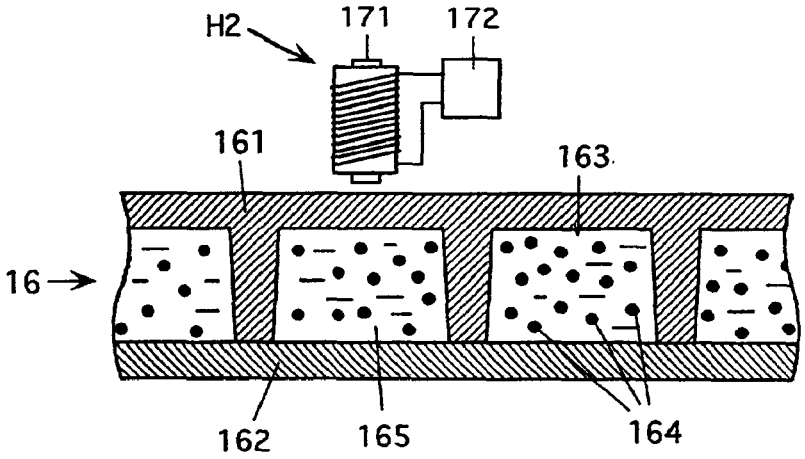
FIG. 5 shows an example of a structure of an image display medium of a magnetic drive type.

FIG. 5 shows by way of example a structure of a reversible image display medium 16 of the magnetic drive type.

The medium 16 shown in FIG. 5 includes light absorbing black magnetic particles 164 and plastic dispersion 165, which contains a dispersion medium, and also contains, if desired, a thickner and a coloring agent. These particles 164 and the dispersion 165 are confined in each of small chambers 163 of the multi-cell structure sheet 160, which are formed by partitioning a space between two substrates 161 and 162. At least one of the two substrates 161 and 162 is transparent.

Instead of the medium of the above structure, the image display medium may have such a structure that the light absorbing black magnetic particles 164 and the plastic dispersion 165 similar to the above are confined in many micro-capsules, and a coating layer of these many micro-capsules is formed on one side of the transparent substrate.

According to these image display mediums, as shown in FIG. 5, a magnetic head H2 is used on the substrate surface of the substrate 161 on the front side (image observation side) to form predetermined magnetic fields for the respective pixels in accordance with the image to be formed. Thereby, magnetic particles 164 are attracted and moved by the magnetic force so that the image is displayed owing to contrast and difference in color between the plastic dispersion 165 and the magnetic particles 164.

The writing magnetic head H2 may have such a structure that includes a group of electromagnets 171, which are arranged for magnetically attracting the magnetic particles 164 within chambers 163 (or micro-capsules in the medium of the micro-capsule type) of the medium 16, toward the front substrate 161, and also includes a DC power source 172 for supplying a DC current to each electromagnet 171.

A coloring agent of the plastic dispersion 165 may be a white pigment or other pigments or dyes. The coloring agent may be added in amount of 10% or less, and preferably 3% or less to the plastic dispersion so that the contrast between the plastic dispersion liquid 165 and the magnetic particles 164 can be increased for clear image display.

The liquid absorbing black magnetic particles 164 are preferably made of magnetic material such as magnetite, ferrite or the like as well as a coloring agent such as carbon black and binder resin, which are kneaded and pulverized into particles having a particle diameter of about 5 $\mu$m–about 100 $\mu$m.

The light absorbing black magnetic particles 164 are added to the plastic dispersion 165 in amount of 5%–30% by weight, and more preferably, of 10%–20% by weight.

The dispersion medium forming the plastic dispersion 165 may be preferably isoparaffin solvent such as Isoper (manufactured by Exxon Chemical Co., Ltd.), a silicone oil or the like.

Several examples of the image forming apparatus and the method of displaying the information relating to the apparatus will now be described. In the following description:

the normal image display medium such as a normal paper sheet may be referred to as "medium PP" or "PP", and the reversible image display medium may be referred to as "medium TP" or "TP".

The image formation mode for the normal image display medium such as normal paper sheet may be referred to as a "PP mode", and the image formation mode for the reversible image display medium may be referred to as a "TP mode".

Figure 6:
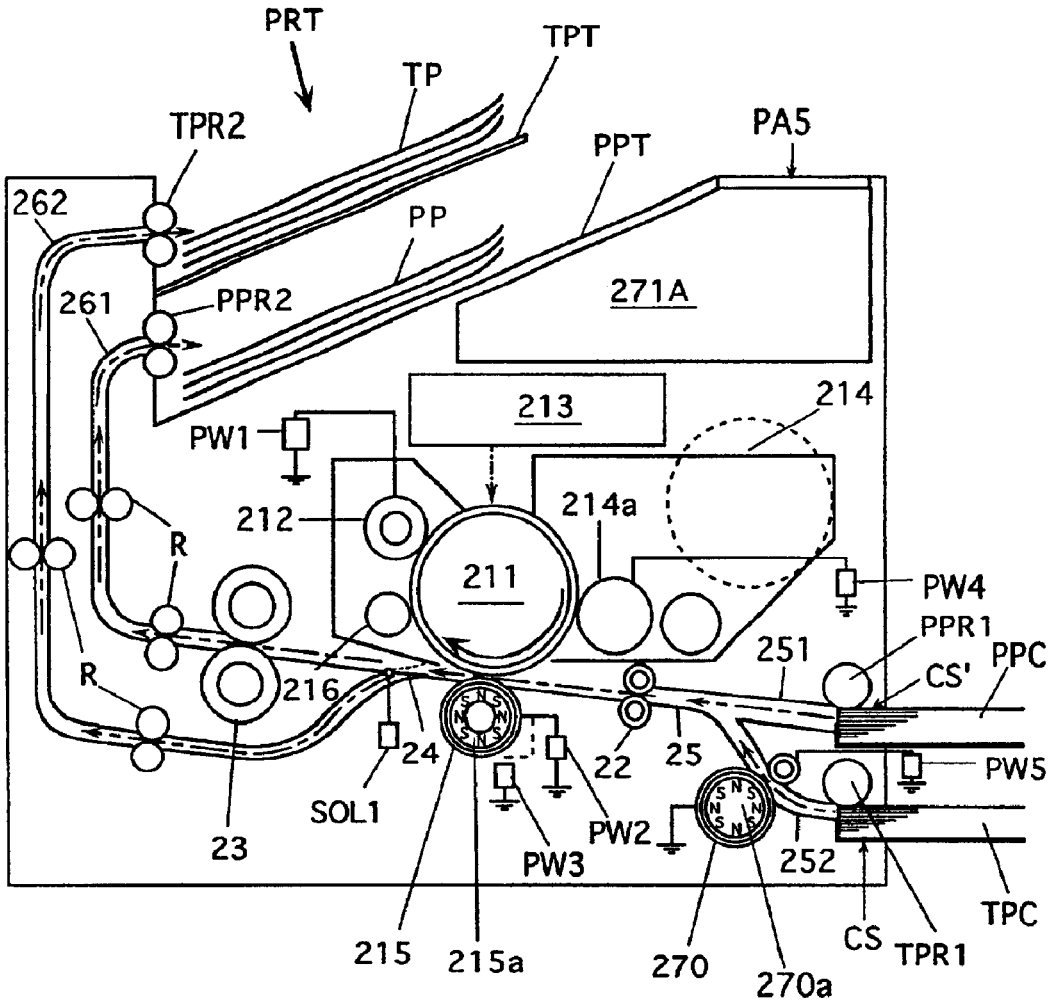
FIG. 6 shows a schematic structure of an example of the image forming apparatus.

<Image Forming Apparatus (Printer) PRT in FIG. 6>

An image forming apparatus PRT has a drum type photosensitive member 211, and also includes a charger (a charging roller in this example) 212, an image exposing device 213, a developing device 214, a transfer device (a transfer roller in this example) 215 and a cleaner (a cleaning roller in this example) 216.

The developing device 214 is a contact type one component developing device in this example, and has a developing roller 214*a* and accommodates a positive charging toner. The transfer roller 215 has a rotatable magnet roller 215*a* provided therein.

The photosensitive member 211 is rotated clockwise in FIG. 6 by a driving device which is not shown. The charging roller 212, the developing roller 214*a*, the transfer roller 215, and furthermore, the cleaning roller 216 and the magnet roller 215*a* can be rotated in a predetermined direction, respectively.

A voltage for charging the photosensitive member can be applied from a power source PW1 to the charging roller 212. The transfer roller 215 can be switched and connected to the power source PW2 or PW3 in accordance with an instruction of a control portion 271A which will be described below, and a transfer voltage at which a toner image on the photosensitive member is transferred onto the medium PP is applied from the power source PW2 and a bias voltage for forming an image on the medium TP is applied from the power source PW3. A developing bias is applied from a power source PW4 to the developing roller 214*a*.

The apparatus PRT further has a timing roller pair 22 on the upstream side of a nip portion between the photosensitive member 211 and the transfer roller 215, an eraser roller pair 270 on the upstream side thereof and upper and lower cassette attaching portions CS' and CS. A cassette PPC for accommodating the medium PP (a normal paper sheet) can be removably attached to the upper cassette attaching portion CS' and a cassette TPC for accommodating the medium TP can be removably attached to the lower cassette attaching portion CS.

A leading roller PPR1 for leading an image display medium one by one faces the cassette PPC to be attached and a leading roller TPR1 for leading the image display medium one by one faces the cassette TPC.

A medium type detecting device is provided in the cassette attaching portions CS' and CS or in the vicinity thereof, which will be described below.

The image display medium led from the cassette PPC can reach the timing roller pair 22 through medium transporting paths 251 and 25.

The image display medium led from the cassette TPC can reach the timing roller pair 22 through medium transporting paths 252 and 25.

The eraser roller pair 270 to be rotated for the medium TP faces the path 252. A bias for image erase can be applied from a power source PW5 to one of the rollers (the upper roller in this example) of the eraser roller pair 270, and the other roller (the lower roller) is grounded. Moreover, a magnet roller 270*a* to be rotated is provided in at least one of the rollers (the lower roller in this example) of the roller pair 270.

The apparatus PRT further has a switching member 24 to lead the medium to the path 261 or 262, which is driven by a solenoid SOL1. The switching member 24 is provided on the downstream side of the nip portion between the photosensitive member 211 and the transfer roller 215. The path 261 for the medium PP extends from the member 24 to a discharge tray PPT through a fixing roller pair 23 and a discharge roller pair PPR2, and the path 262 for the medium TP makes a detour around the fixing device 23 and extends to a discharge tray TPT through a discharge roller pair TPR2. Medium guide roller pairs R are provided in proper positions on the paths 261 and 262.

Furthermore, the control portion 271A for controlling the operation of the whole image forming apparatus is provided above the image exposing device 213, to which an operation panel PA5 is connected. The medium type detecting device provided in the apparatus PRT is one of those shown in FIGS. 25(A) to 25(C), FIGS. 26(A) to 26(D), FIGS. 27(A) and 27(B), and FIGS. 28(A) and 28(B) or others which will be described below.

Figure 25A:
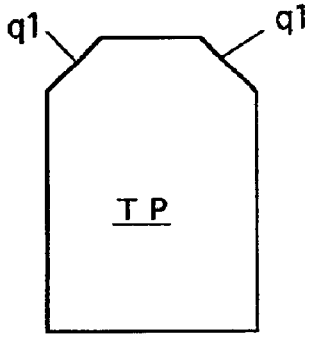
FIGS. 25(A) to 25(C) are views showing an example of a medium type detecting device, FIGS. 25(A) and 25(B) being plan views showing an example of a medium TP in which a medium type can be detected and FIG. 25(C) being a view showing a state in which the medium is detected.
Figure 25B:
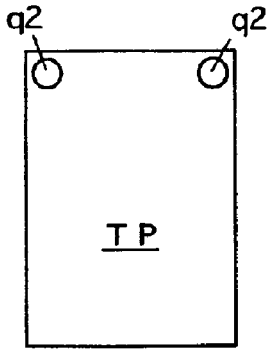
Figure 25C:
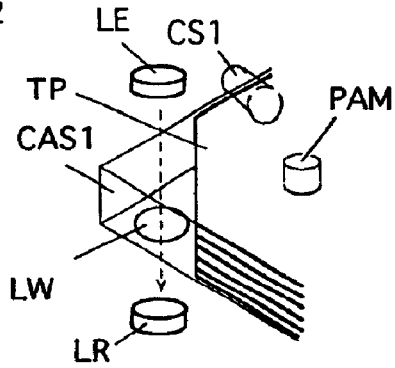

The medium type detecting device shown in FIGS. 25(A) to 25(C) includes a cassette CAS1 capable of accommodating either the medium PP or the medium TP which is provided with a light transmission window LW in a corner portion on the bottom thereof, and a light emitting element LE and a light receiving element LR which are positioned above and below the light transmission window LW when the cassette is attached to the image forming apparatus body as shown in FIG. 25(C).

When the medium TP having a cut corner portion q1 as shown in FIG. 25(A) or provided with a transmission hole q2 in the corner portion as shown in FIG. 25(B) is accommodated in the cassette and the cassette is attached in the apparatus body, the cut corner portion q1 or the transmission hole q2 portion in the medium faces the light emitting element and the light receiving element so that light transmitted from the light emitting element LE is detected by the light receiving element LR and the medium TP can be detected.

On the other hand, when the medium PP having no cut corner portion or having no transmission hole is accommodated in the cassette CAS1 and the cassette CAS1 is attached to the apparatus body, the light transmitted from the light emitting element LE cannot be detected by the light receiving element LR so that the medium PP is detected.

The cassette attaching portion of the image forming apparatus body is provided with a cassette sensor CS1 for detecting the presence of the cassette and a sensor PAM for detecting the presence of the image display medium in the cassette attached to the apparatus body. This respect is the same also when the following medium type detecting device is to be employed.

Figure 26A:
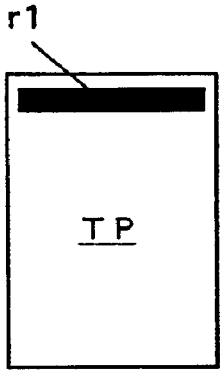
FIGS. 26(A) to 26(D) are views showing another example of the medium type detecting device, FIGS. 26(A) and 26(C) being plan views showing another example of the medium TP in which a medium type can be detected and FIGS. 26(B) and 26(D) being views showing a state in which the medium is detected.
Figure 26B:
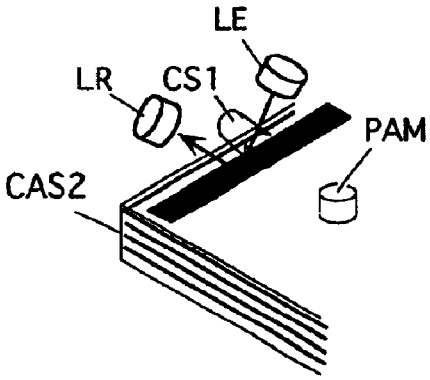
Figure 26C:
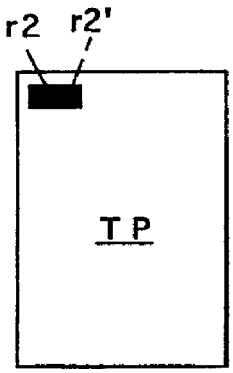
Figure 26D:
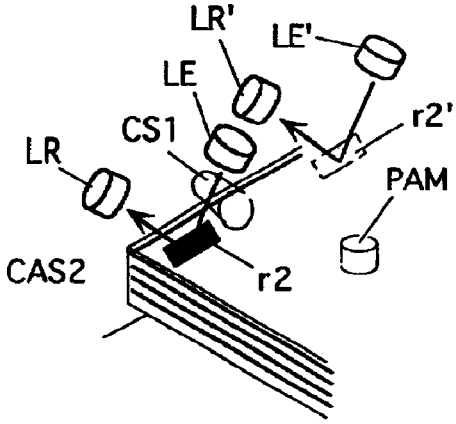

The medium type detecting device shown in FIGS. 26(A) to 26(D) includes a light emitting element LE and a light receiving element LR and furthermore a light emitting element LE' and a light receiving element LR' which are opposed to the medium accommodated in a cassette CAS2 capable of accommodating either the medium PP or the medium TP when the cassette CAS2 is attached to the image forming apparatus body as shown in FIGS. 26(B) and 26(D).

When the medium TP provided with a light reflecting surface r1 at its end as shown in FIG. 26(A) or the medium TP provided with a light reflecting surface r2 indicative of the surface side (front side) at its end as shown in FIG. 26(C) is accommodated in the cassette and the cassette is housed in the apparatus body, the light emitted from the light emitting element LE is reflected by the reflecting surface r1 or r2 of the medium and is received by the light receiving element LR. Consequently, the medium TP can be detected. In FIGS. 26(C) and 26(D), the surface side (front side) of the medium TP can be also detected.

In FIGS. 26(C) and 26(D), when the medium TP is turned over (located up side down) and accommodated in the cassette, a light reflecting surface r2' on the back side of the medium TP is detected by the light emitting element LE' and the light receiving element LR'. Consequently, the medium TP can be detected and it is also detected that the medium TP has a back side out.

When the medium PP having no reflecting surfaces r1, r2 and r2' is accommodated in the cassette CAS2 and the cassette CAS2 is attached to the apparatus body, the light transmitted from the light emitting elements LE and LE' cannot be detected by the light receiving elements LR and LR' or the light can be detected in a small quantity. Consequently, the medium PP can be detected.

The medium type detecting device shown in FIGS. 26(A) to 26(D) can detect the medium PP and the medium TP even if they are accommodated together in the cassette CAS2.

In place of the light reflecting surfaces r1, r2 and r2', the medium PP and the medium TP may have electrostatic capacities, surface resistances and quantities of magnetism or the like which are different from each other. By detecting them, the medium PP and the medium TP may be distinguished from each other.

Figure 27A:
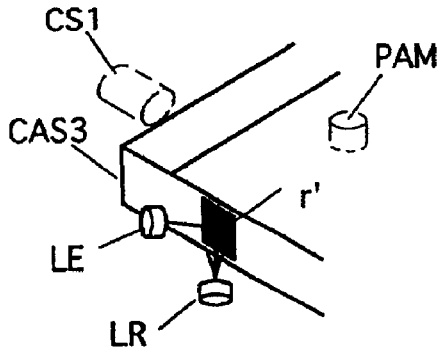
FIGS. 27(A) and 27(B) are views showing yet another example of the medium type detecting device, FIG. 27(A) showing a state in which a medium TP is detected by means of a special cassette for accommodating the medium TP and FIG. 27(B) showing a state in which a medium PP is detected by means of a special cassette for accommodating the medium PP.
Figure 27B:
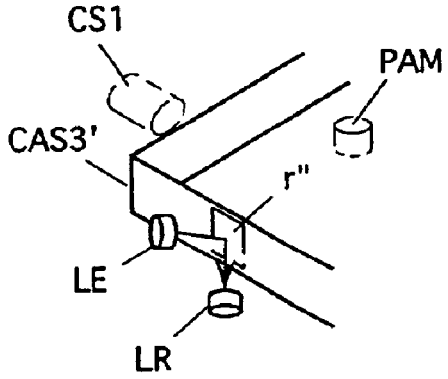

The medium type detecting device shown in FIGS. 27(A) and 27(B) includes a cassette CAS3 for accommodating the medium TP which has a low reflection density surface r' provided on a side surface thereof, a cassette CAS3' for accommodating the medium PP which has a high reflection density surface r" provided on a side surface thereof, a cassette sensor CS1 for detecting the attachment of the cassette when the cassette is attached to the apparatus body, and a light emitting element LE and a light receiving element LR which faces the reflecting surface r' or r" of the attached cassette as shown in FIGS. 27(A) and 27(B).

When the cassette CAS3 is attached, the cassette sensor CS1 detects the attachment thereof and the light emitting element LE and the light receiving element LR detect the low reflection density surface r'. Consequently, the medium TP can be detected.

When the cassette CAS3' is attached, the cassette sensor CS1 detects the attachment thereof and the light emitting element LE and the light receiving element LR detect the high reflection density surface r". Consequently, the medium PP can be detected.

The reflecting surface r' may be the high reflection density surface and the reflecting surface r" may be the low reflection density surface.

Figure 28A:
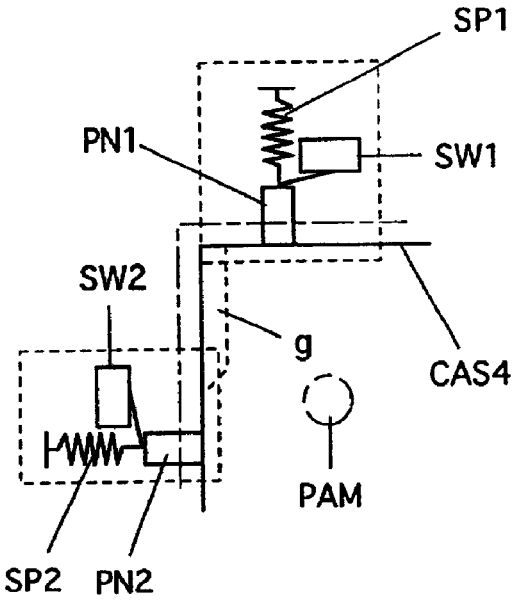
FIGS. 28(A) and 28(B) are views showing a further example of the medium type detecting device, FIG. 28(A) showing a state in which a medium TP is detected by means of a special cassette for accommodating the medium TP and FIG. 28(B) showing a state in which a medium PP is detected by means of a special cassette for accommodating the medium PP.
Figure 28B:
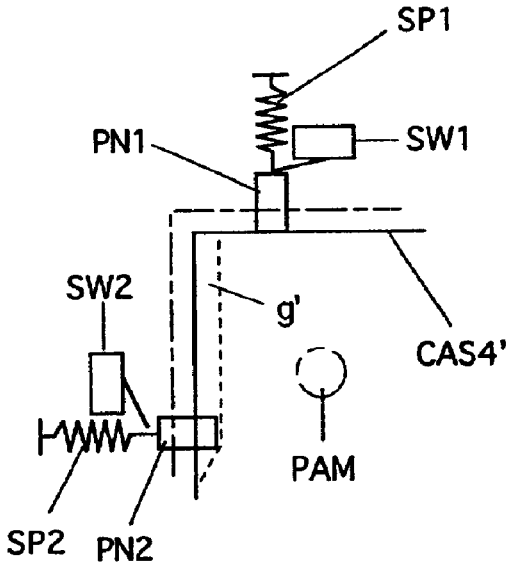

A medium type detecting device shown in FIGS. 28(A) and 28(B) includes two sets of sensors, which are arranged on the cassette attaching portions of the image forming apparatus body, and more specifically includes:

a sensor formed of a pin PN1, which can be pushed by a front end surface of the cassette while it is being attached, and thereby is retreated against a spring SP1, and a switch SW1 activated by the retreating pin PN1, and a sensor formed of a pin PN2 which is fitted to a groove g arranged on the side surface of the cassette while it is being attached, is pushed back against a spring SP2 to activate the switch SW2 by the side portion of the cassette not provided with the groove g if the groove g is short because it is formed in the cassette CAS4 accommodating the medium TP, and does not move backward from the position fitted into a groove g' if the groove g' is arranged in the cassette CAS4' for accommodating the medium PP, and thus is long.

When both the switches SW1 and SW2 are activated, it is determined that the mediums TP are to be handled. When only the switch SW1 is activated, it is determined that the mediums PP are to be handled.

In the image forming apparatus PRT, the cassette PPC accommodating the medium PP is attached in the cassette attaching portion CS'. The cassette PPC is the cassette CAS1 or CAS2 accommodating the medium PP or the cassette CAS3' or CAS4' which is special for the medium PP.

Moreover, the cassette TPC is attached to the cassette attaching portion CS on the underside. The cassette TPC is the cassette CAS1 or CAS2 accommodating the medium TP or the cassette CAS3 or CAS4 which is special for the medium TP.

Any of the medium type detecting devices is provided on each of the cassette attaching portions CS and CS' if necessary.

Both an operation for forming an image on the medium PP and an operation for forming an image on the medium TP are controlled by the control portion 271A for controlling the operation of the whole apparatus PRT.

Figure 7:
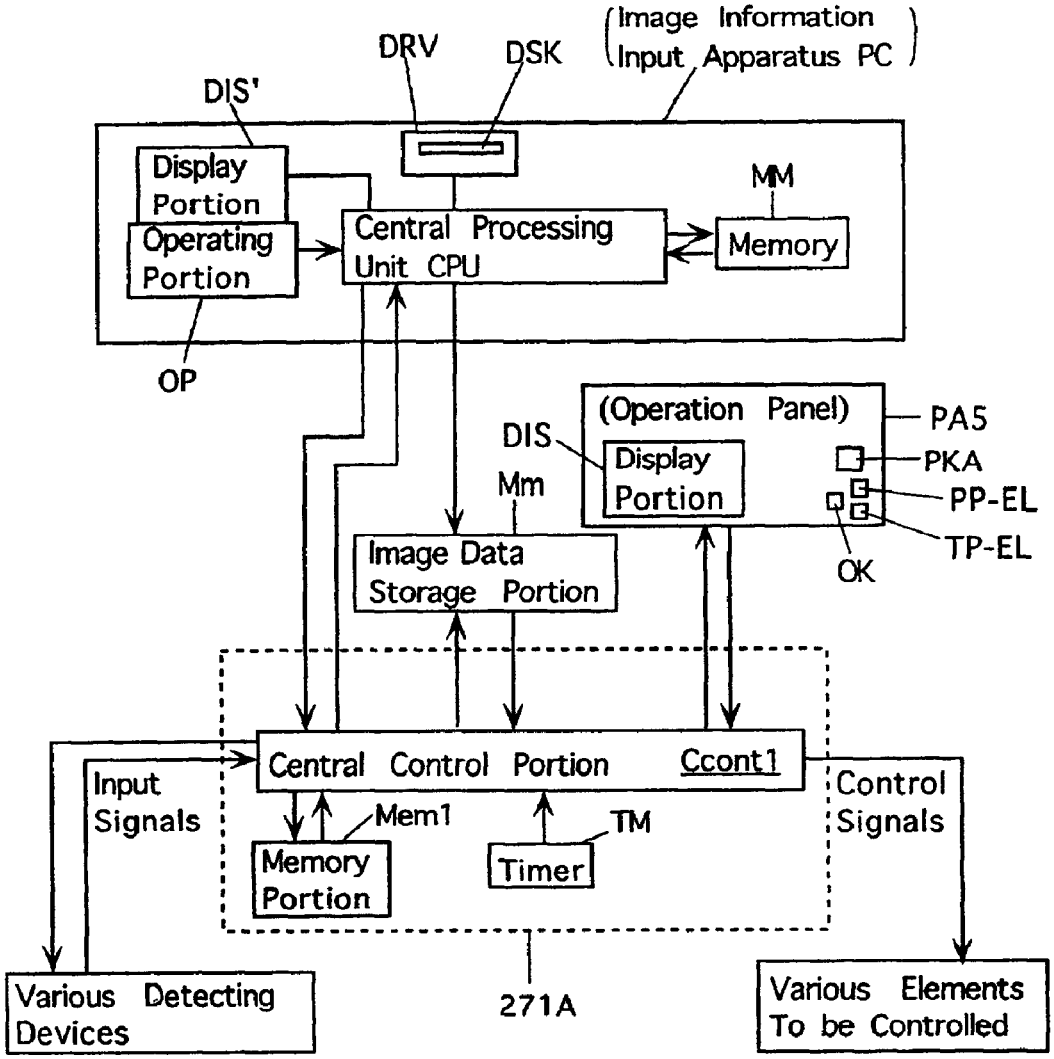
FIG. 7 is a block diagram schematically showing a control circuit of the apparatus shown in Fig.

FIG. 7 is a block diagram schematically showing a control circuit of the image forming apparatus (printer) PRT.

As shown in FIG. 7, the control portion 271A in the apparatus PRT includes a central control portion Ccontl, and furthermore, a memory portion Mem1 for storing a program for controlling the operation of the apparatus and various set data necessary for executing the program, an internal timer TM for generating timings of various element operations and the like which are connected to the central control portion.

In to the central control portion Ccontl, information can be input from various detecting devices and the like, for example, timing detection signals sent through an input port (not shown) from a pre-regist sensor which will be described below, a medium discharge sensor or the like, a temperature detection signal sent from a temperature detecting sensor in the fixing roller pair 23, a medium type detection signal sent from the medium type detecting device, a medium state (the directions of a surface and a back face(back side) or the like) signal, a medium presence detection signal sent from a sensor PAM (see FIG. 25(C) and others), and the like.

The image data storage portion Mm, the operation panel PA5 and various elements to be operatively controlled are connected to the central control portion Ccontl. Control signals are output to the various elements.

The image data storage portion Mm serves to once store image data transferred from the image information input apparatus PC such as a personal computer, a facsimile receiver or a print server.

The various elements to be operatively controlled may be the rotary drive portion of the photosensitive member 211, the rotary drive portion of the charging roller 212 and the power source PW1 connected to the roller 212, the image exposing device 213, the driving portion of the developing device 214 and the developing bias power source PW4, the driving portion of the transfer roller 215 and the transfer power source PW2 connected to the roller 215, the driving portion of the magnet roller 215*a*, the driving portion of the medium leading or supplying rollers PPR1 and TPR1, the driving portion of the eraser roller pair 270 and the power source PW5, the driving portion of the solenoid SOL1 for the switching member 24, the driving portion of the fixing roller pair 23, the driving portion of the discharge rollers PPR2 and TPR2, portions related thereto and the like.

The operation panel PA5 is provided with a key PKA for indicating an image formation start, a display portion DIS, a lamp PP—EL for giving a notice of the presence of a medium in the cassette PPC, a lamp TP—EL for giving a notice of the presence of a medium in the cassette TPC, a lamp OK indicating that print can be allowed, and the like.

The image information input apparatus PC connected to the image forming apparatus PRT has a central processing unit CPU to which a memory MM, an operating portion OP such as a keyboard, a display portion DIS', a drive DRV of a recording medium DSK and the like are connected.

An image output command can be sent from the central processing unit CPU of the image information input apparatus PC to the central control portion Ccont 1 and image data can be transferred to the image data storage portion Mm and can be once stored in the storage portion Mm.

The central control portion Ccontl gives an instruction for image formation on a medium based on the data thus stored in the image data storage portion Mm.

Next, description will be given to an example of the image formation in the PP mode using the normal paper sheet and the image formation in the TP mode using the medium TP1 in the image forming apparatus mentioned above.

PP Mode (Image Formation on a Plain Normal Paper Sheet Through an Electrophotographic Method)

The medium PP (normal paper sheet) accommodated in the cassette PPC is led from the cassette by the leading roller PPR1, is delivered to the timing roller pair 22 and is caused to hit on the nip portion thereof. At this time, the leading end of the medium PP is detected by a pre-regist sensor which is not shown and a timing of the transfer of a toner image on the photosensitive member for the medium PP is taken.

The surface of the photosensitive member 211 is charged to +500 V by the charging roller 212, an image is exposed onto the charged area by the image exposing device 213, and an electrostatic latent image corresponding to the image to be formed is formed. The surface potential of the exposed portion is attenuated to the vicinity of 0 V and the portion other than the above is maintained to be +500 V.

The electrostatic latent image reaches the developing device 214 and a developing bias of +400 V is applied from the power source PW4 to the developing roller 214*a*.

Accordingly, the electrostatic latent image formed on the photosensitive member 211 is developed with the toner into a visible image by the electric field formed between the electrostatic latent image and the developing roller 214*a*. In other words, only the exposed portion is developed.

Next, the toner image on the photosensitive member is transferred by the transfer roller 215 onto the medium PP sent in synchronization with the toner image on the photosensitive member from the timing roller pair 22. At this time, a bias of −1000 V is applied to the transfer roller 215 and the positively chargeable toner is electrostatically transferred from the photosensitive member onto the medium PP.

Then, the photosensitive member 211 is cleaned by the cleaning roller 216 so that the toner remaining on the photosensitive member 211 is removed, the surface potential is initialized again by the charging roller 212 for the next image formation.

The medium PP having the toner image transferred thereto passes through the fixing roller pair 23 so that the toner image is fixed onto the medium under heat and pressure, and the medium PP is then discharged to the tray PPT.

TP Mode (Using the Medium TP1)

The medium TP1 accommodated in the cassette TPC is led from the cassette by the leading roller TPR1, is delivered to the timing roller pair 22 through the eraser roller pair 270 and is caused to hit on the nip portion thereof. At this time, the leading end of the medium TP1 is detected by the pre-regist sensor which is not shown and a timing of the image write to the medium TP1 is taken.

The eraser roller pair 270 to which a bias voltage of +250 V is applied from the power source PW5 moves white developer particles in the medium TP1 to one of the substrates and black developer particles to the other substrate, thereby initialization of the medium TP1 (which is also erased when the image is already formed) is performed, and furthermore, the rotating magnet roller 270*a* gives an oscillating magnetic field to the developer containing magnetic particles included in the medium TP1 and stirs the same developer, thereby enhancing the fluidity of the developing particles and making the initialization of the medium TP1 easy.

The eraser roller pair 270 may be provided on the upstream side or downstream side of the timing roller pair 22. One roller pair may serve as the eraser roller pair and the timing roller pair.

The surface of the photosensitive member 211 is charged to +500 V by the charging roller 212, an image is exposed onto the charged area by the image exposing device 213, and an electrostatic latent image corresponding to the image to be formed is formed.

Next, the electrostatic latent image is opposed to the medium TP1 sent from the timing roller pair 22 and a contrast image corresponding to the electrostatic latent image on the photosensitive member is formed on the medium TP1 by the transfer roller (acting as a counter electrode, in this case) 215 to which a bias for image writing is applied from the power source PW3.

At this time, the developing device is caused to retreat by a developing device retreating mechanism which is not shown. However, the developing device does not need to retreat depending on the type thereof. If the development is not carried out with the toner and the electrostatic latent image can be prevented from being disturbed, such developing device may be employed.

A peripheral speed ratio (θ) of a circumferential speed of the photosensitive member to that of the transfer roller (the counter electrode roller) is set to be constant with θ=1 and a bias of +250 V is applied to the transfer roller to form the image by Coulomb force acting between an electrostatic field formed in the region where the photosensitive member is opposed to the transfer roller (the counter electrode roller) and the charged developing particles included in the medium TP1. In the image formation, moreover, the magnet roller 215*a* provided in the transfer roller 215 is rotated and the developing particles in the medium TP1 are magnetically stirred to enhance the fluidity thereof. In this state, the image is formed.

Thus, the medium TP1 having an image formed thereon is discharged to the tray TPT by the passage 262.

The trays PPT and TPT may be identical to each other.

Although, the medium TP1 is caused to make a detour around the fixing device 23 in the image forming apparatus, the medium TP1 may be caused to pass through the fixing device 23 portion and the fixing device 23 may be caused to retreat at that time such that the medium TP1 is not adversely affected.

Furthermore, the image forming apparatus PRT may be provided with an electric charge eraser for erasing electric charges remaining on the photosensitive member 212 prior to the charging carried out by the charging roller 212 after the toner image is transferred onto the medium PP or the image is written to the medium TP. This respect is the same in image forming apparatuses which will be described below.

Figure 8:
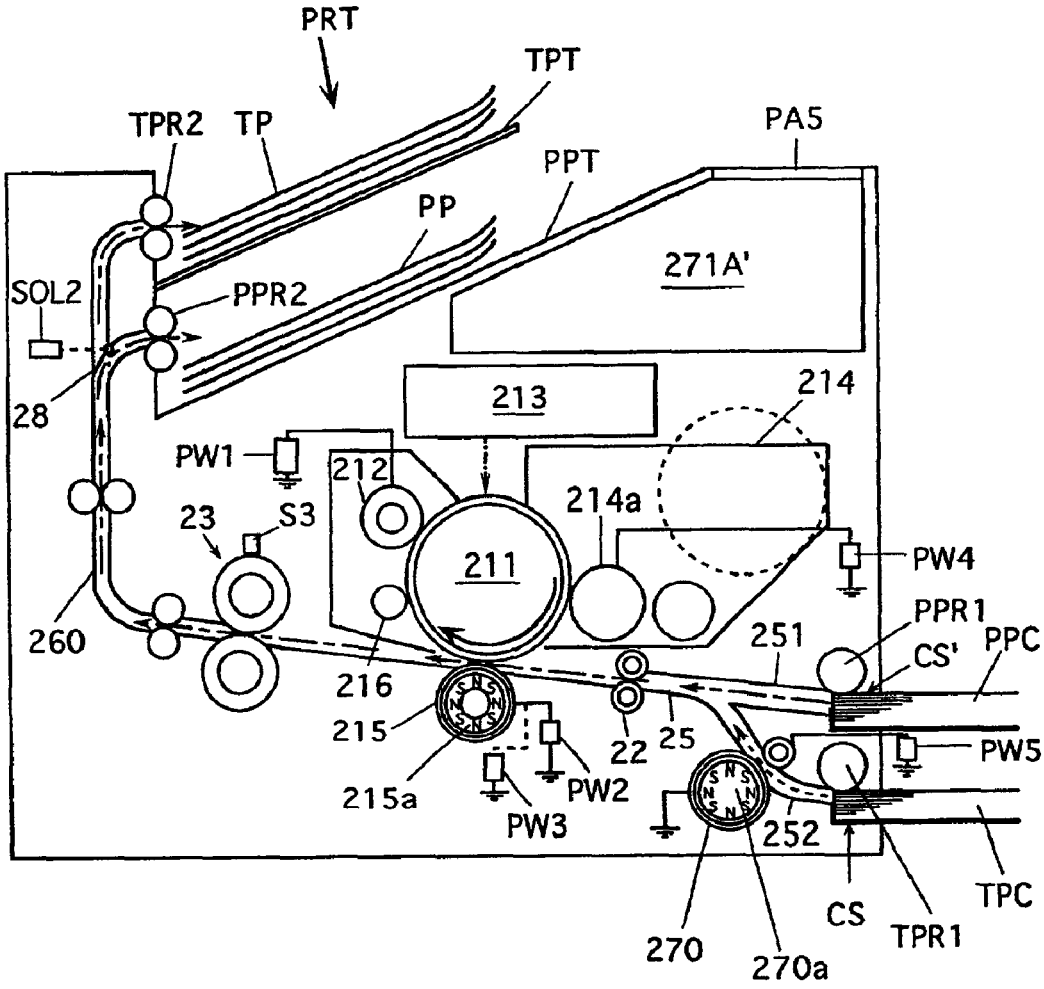
FIG. 8 shows a schematic structure of another example of the image forming apparatus.

<Image Forming Apparatus (Printer) PRT in FIG. 8>

An image forming apparatus shown in FIG. 8 differs from the apparatus shown in FIG. 6 in that either of the medium PP and the medium TP having an image formed thereon passes through the fixing device 23 portion toward the tray PPT or TPT via the transporting path 260 provided with a switching member 28 driven by a solenoid SOL 2. Moreover, a sensor S3 for detecting the temperature of the fixing device is provided and information about the temperature is input to the control portion 271A'.

The control portion 271A' has basically the same structure as that of the control portion 271A in the image forming apparatus in FIG. 6 and the image forming apparatus in FIG. 8 operates based on the instruction of the control portion 271A'. An operation panel PA5 is connected to the control portion 271A' and the same image information input apparatus PC as that shown in FIG. 6 is connected thereto.

Other structures are the same as those of the apparatus shown in FIG. 6 and the same parts have the same reference numerals.

Figure 9:
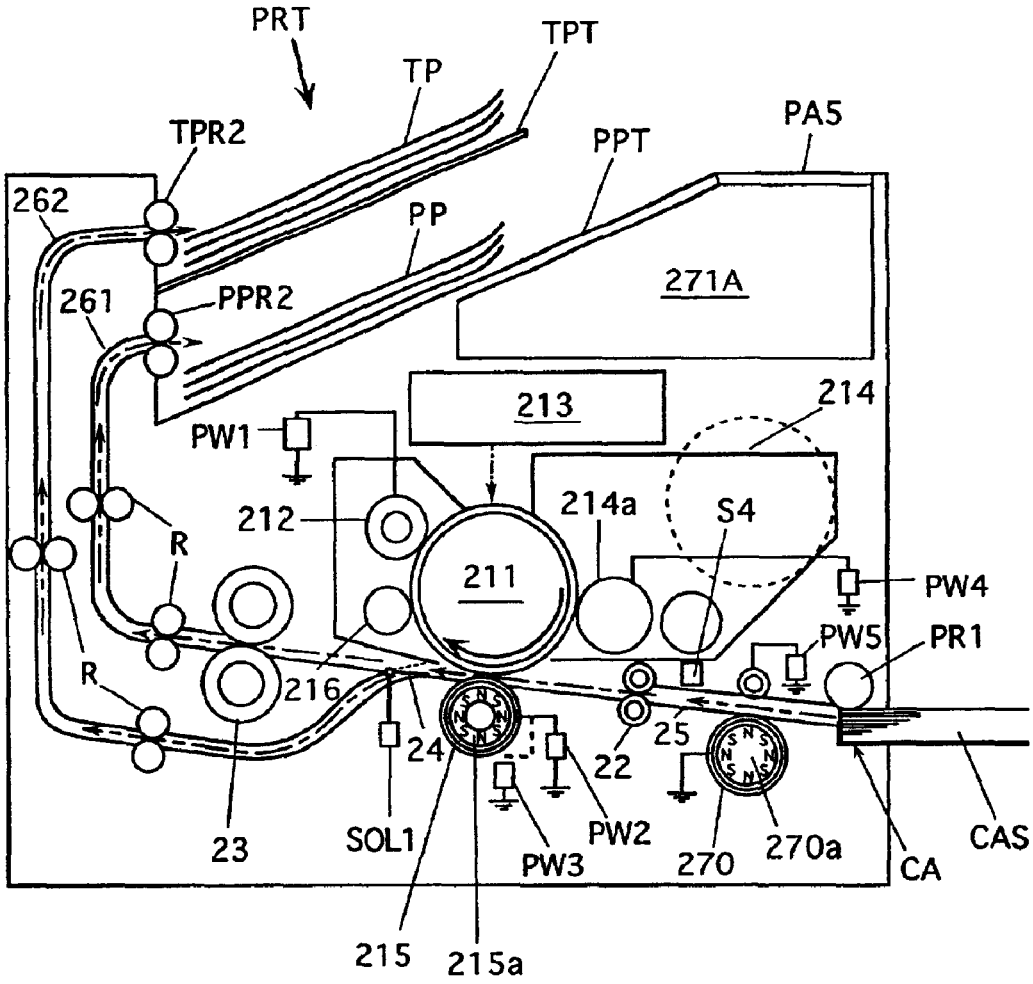
FIG. 9 shows a schematic structure of further another example of the image forming apparatus.

<Image Forming Apparatus (Printer) PRT in FIG. 9>

An image forming apparatus PRT shown in FIG. 9 differs from the apparatus shown in FIG. 6 in that only one cassette attaching portion CS followed by the eraser roller pair 270 is used and a cassette CAS is attached thereto.

A medium type detecting sensor S4 is provided on the slightly upstream side of the timing roller pair 22.

Other structures are the same as those of the apparatus shown in FIG. 6 and the same parts and parts having basically the same structures take the same reference numerals.

Next, description will be given to the specific examples of the detection of the state in the image forming apparatus PRT and the setting state for image formation in the image forming apparatus PRT as well as job control. In order to avoid complication, it is assumed that all the results of the detection other than the described detection are normal.

In flow charts showing the display control operation of the control portion of the image forming apparatus and (or) a control portion of the image information input apparatus which will be referred in the following description and the like, the image formation is shown as "printing" or "print". The image input apparatus is shown as "PC" and the image forming apparatus is shown as "PRT". A plain (normal) paper sheet is used for the medium PP.

Moreover, a cassette PPC is shown as a "paper feeding cassette 1" or "cassette 1", a cassette TPC is shown as a "paper feeding cassette 2" or "cassette 2", a medium cassette is shown as a "paper feeding cassette" or "cassette", medium type detection is shown as "paper type detection", a medium is shown as a "paper" and the like. [ ] and description thereunder indicate the contents to be displayed on the display portion DIS in the image forming apparatus and the display portion DIS' in the image information input apparatus.

EXAMPLE 1

The image forming apparatus shown in FIG. 6 is used.

In this case, medium type detection is carried out by means of any of the medium type detecting devices shown in FIGS. 25(A) to 25(C), FIGS. 26(A) to 26(D), FIGS. 27(A) and 27(B) and FIGS. 28(A) and 28(B).

Figure 10:
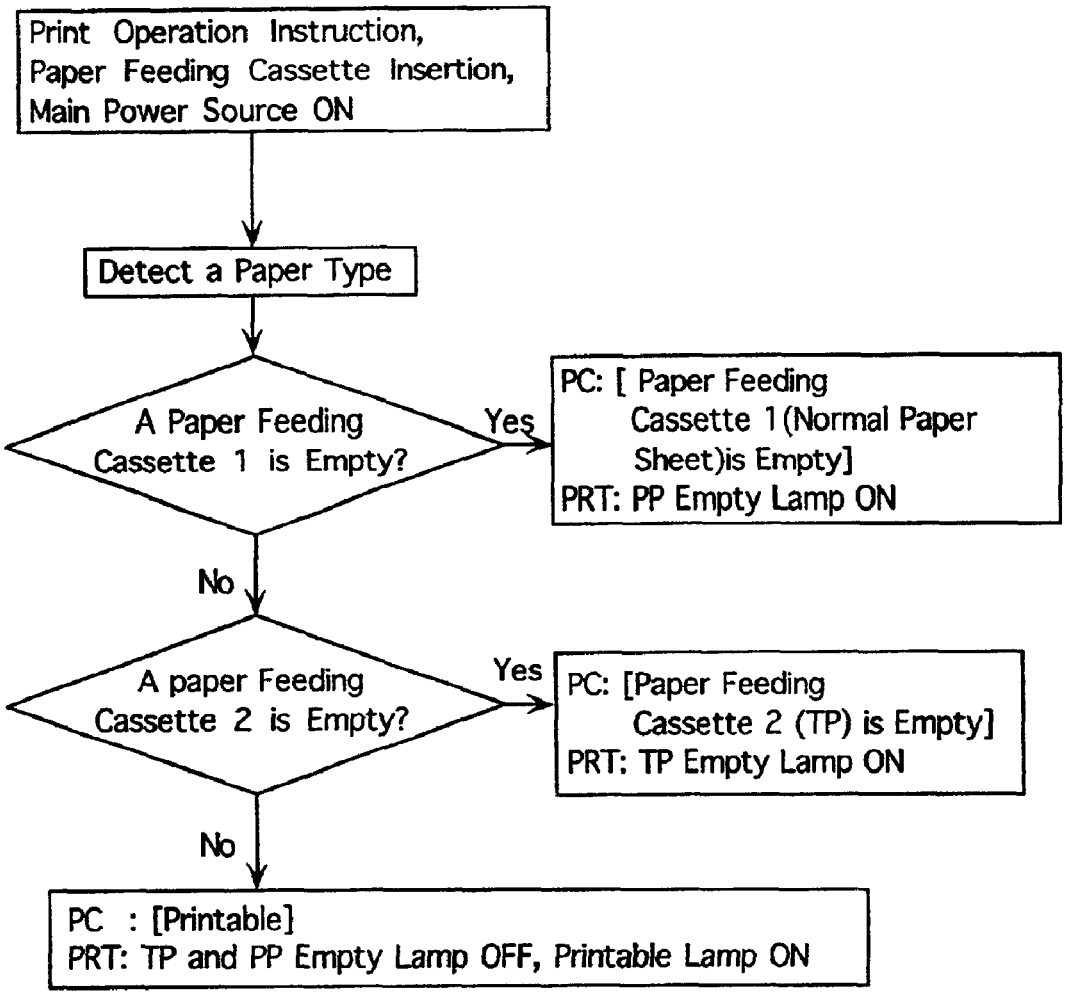
FIG. 10 is a flow chart showing an example of display control.

As shown in FIG. 10, in the case where a print operation instruction is sent from the image information input apparatus PC to the apparatus PRT, the medium type detection is carried out when a main power source is turned ON or so if the cassette is attached to the apparatus PRT.

According to the result, if there is no medium in the cassette, the empty lamp of the display portion DIS in the apparatus PRT is turned ON so that the contents shown in FIG. 10 are displayed.

EXAMPLE 2

The example 2 is the same as the example 1 except that the medium type detection is carried out through test printing. In this case, a display control operation is the same as that in FIG. 10.

Figure 11:
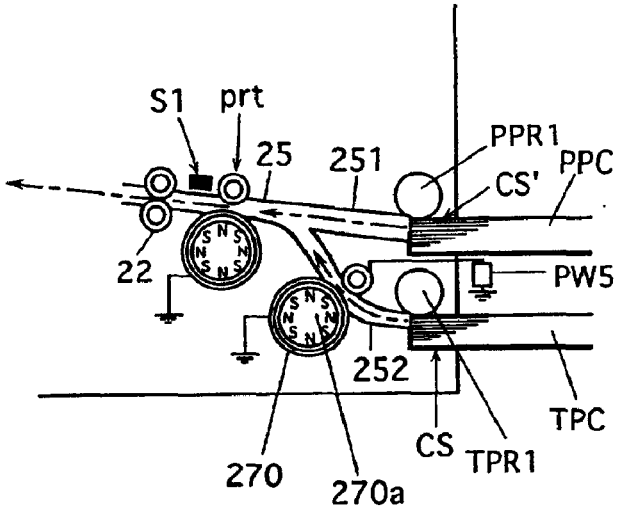
FIG. 11 is a view showing an example of medium type detection through a test printing mechanism.

As a detecting device, as shown in FIG. 11, a test printing mechanism prt is provided on the slightly upstream side of the timing roller pair 22 to print a test pattern on the medium and to discriminate the pattern by a detecting sensor S1 such as an optical sensor in the apparatus PRT.

The test pattern can be printed on the medium TP and nothing is printed on the medium PP. Consequently, the medium type can be detected by the sensor S1.

In this case, a combination with medium type detection in the cassette may be employed.

EXAMPLE 3

The example 3 is the same as the example 1 except that the medium type detection is carried out based on the shape of the medium or the like. Any shape of the medium or the like can be used if at least one of a size, a shape and the like is different from that of the medium PP so that the medium type can be detected.

Figure 12A:
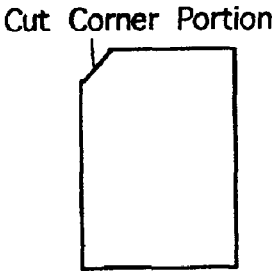
FIGS. 12(A) to 12(C) are views showing an example of the medium type detection through the shape of a medium, FIG. 12(A) being a view showing an example in which the corner portion of the medium is cut, FIG. 12(B) being a view showing an example in which the corner portion of the medium is provided with a transmission hole, and FIG. 12(C) being a view showing an example in which the medium is detected by an optical sensor provided on the slightly upstream side of a timing roller pair.
Figure 12B:
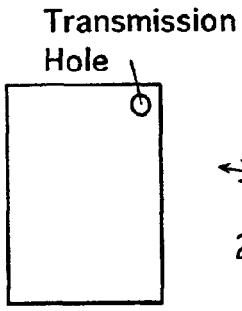
Figure 12C:
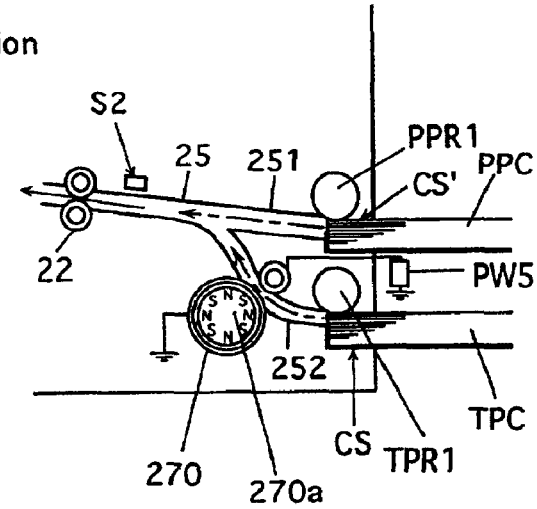

In an example shown in FIG. 12(A), a corner portion of the medium TP is cut. In an example shown in FIG. 12(B), the corner portion of the medium TP is provided with a transmission hole. These are detected by an optical sensor S2 provided on the slightly upstream side of the timing roller pair 22 as shown in FIG. 12(C).

EXAMPLE 4

The example 4 is the same as the example 3 except that a mark or sign formed on the medium is detected by a sensor so that medium type detection is carried out.

Figure 13A:
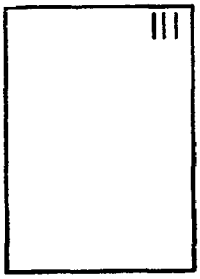
FIGS. 13(A) to 13(C) are views showing an example of medium type detection through a character or the like on the medium.
Figure 13B:
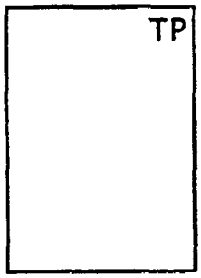
Figure 13C:
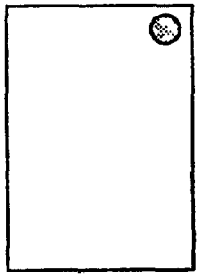

For the mark and the sign, pattern information, character information and the like may be used as illustrated in FIGS. 13(A) to 13(C). Such mark, sign or the like may be positioned on a part of the medium or the whole medium.

EXAMPLE 5

The example 5 is the same as the example 1 except that the surface (front surface) and back face (back side) of the medium TP are detected by test printing.

Figure 14:
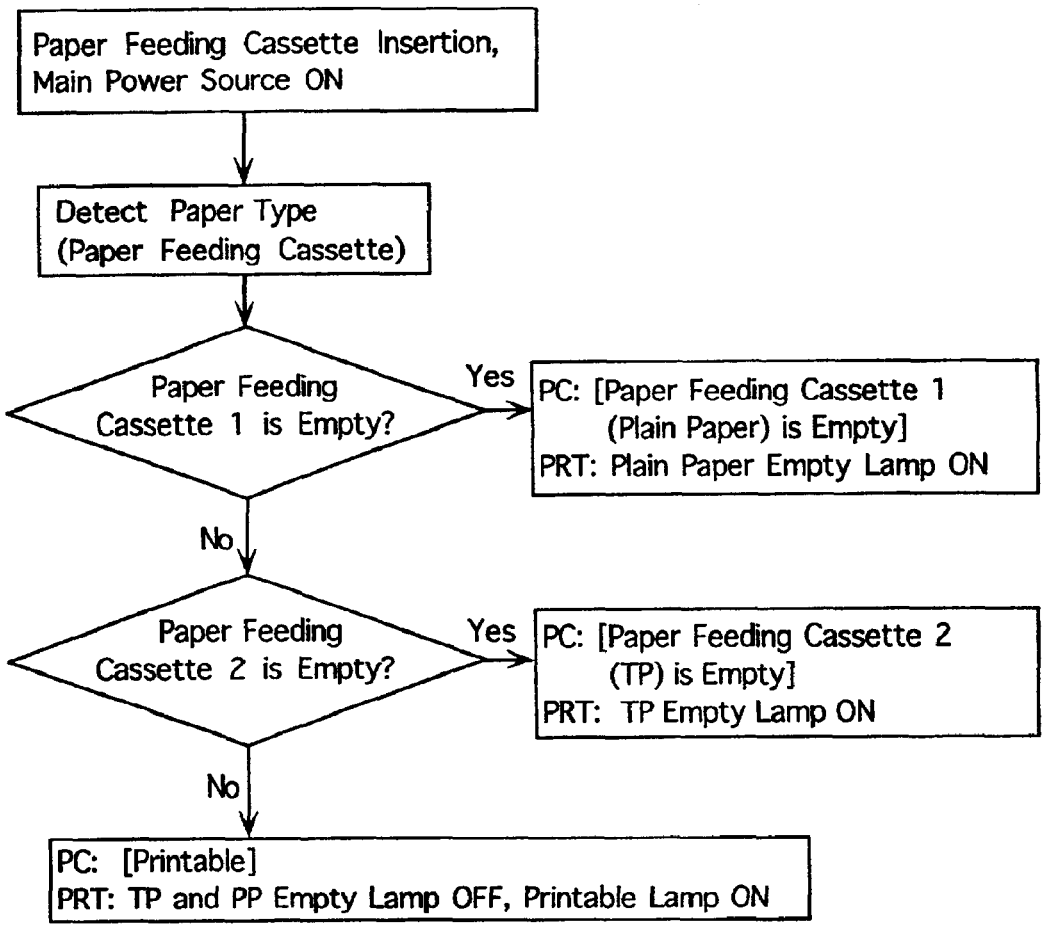
FIG. 14 is a flow chart showing another example of the display control.
Figure 15:
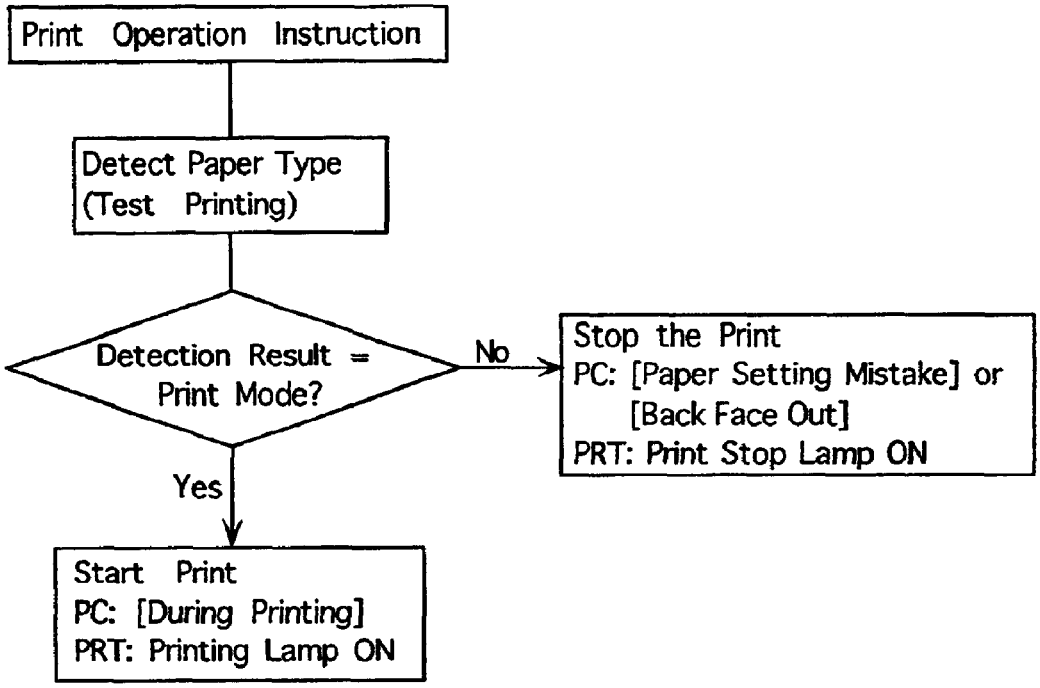
FIG. 15 is a flow chart showing yet another example of the display control.

Medium type detection is carried out in the same manner as that in the example 1 (see FIG. 14) and the surface side and back face (back side) of the medium TP are detected in the same manner as the medium type detection to be carried out by the test printing mechanism in the example 2 (see FIG. 15).

If the print test pattern is detected by the test printing mechanism, the medium TP is oriented normally. If not so, it is decided that the direction of the medium TP has the back face (back side) out or the medium is set by mistake.

EXAMPLE 6

The apparatus PRT shown in FIG. 8 is used.

The example 6 is the same as the example 2 except that the temperature of the fixing device is detected in place of the medium type detection.

Figure 16:
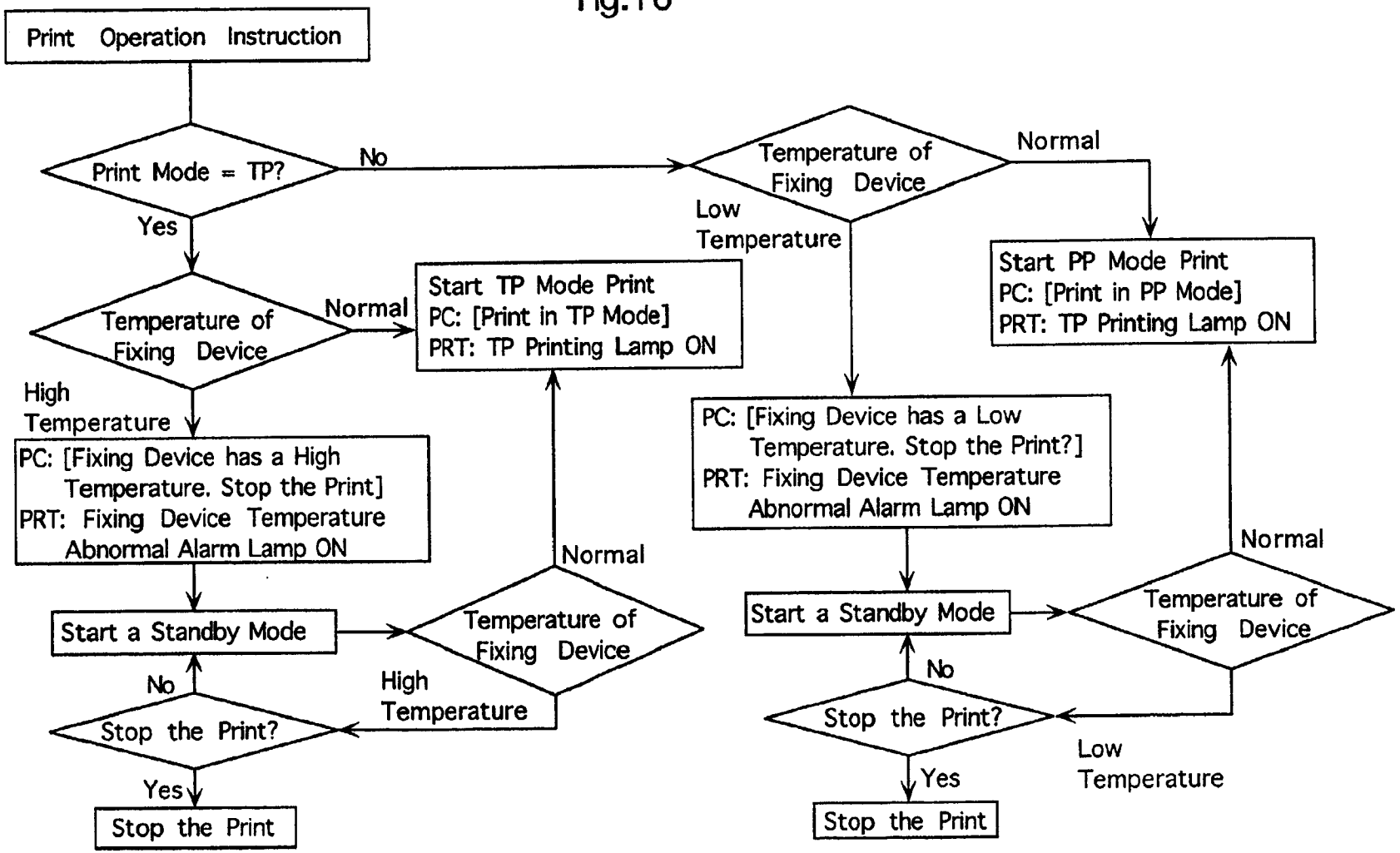
FIG. 16 is a flow chart showing a further example of the display control.

FIG. 16 is a flow chart showing a display control operation to be carried out in this case.

The temperature of the fixing device is detected corresponding to a print mode in response to a print instruction. If the temperature of the fixing device is normal in the TP mode, print is carried out. If the temperature of the fixing device is high in the TP mode, a standby mode is started. The print is carried out if the temperature of the fixing device is normal in the PP mode, and the standby mode is started if the temperature of the fixing device is low in the PP mode.

If the temperature of the fixing device is abnormal in each mode, a fixing device temperature abnormal alarm is displayed on the display portion(s). If the print is started, a display for printing is carried out.

EXAMPLE 7

The example 7 is the same as the example 1 except that the apparatus PRT having one cassette attaching portion shown in FIG. 9 is used.

Figure 17:
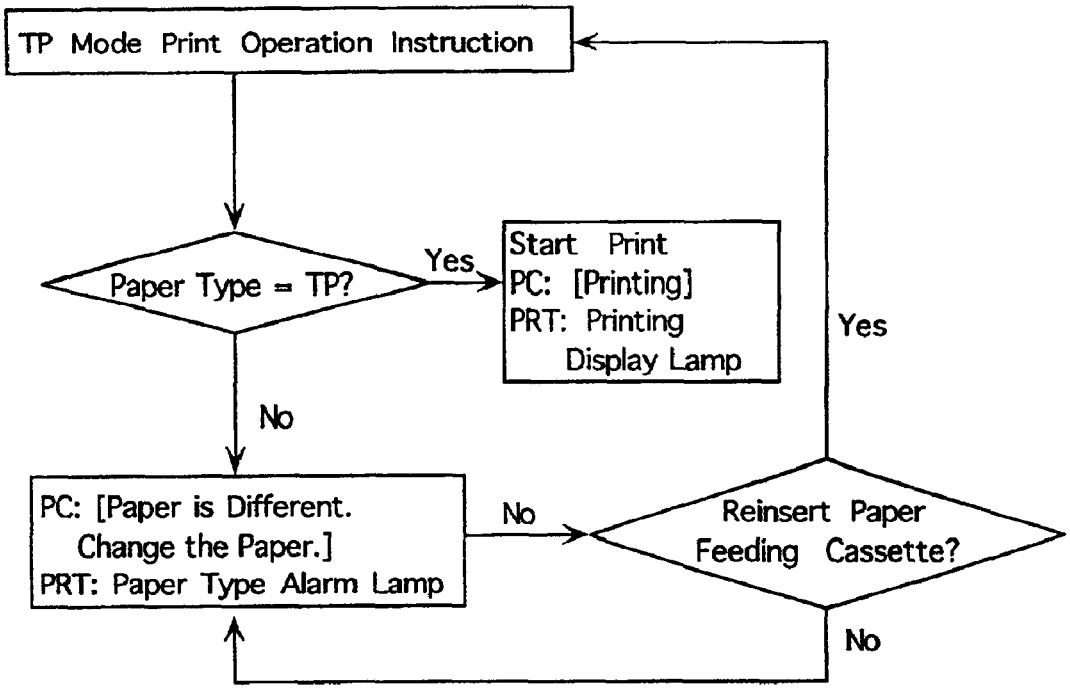
FIG. 17 is a flow chart showing a further example of the display control.

FIG. 17 is a flow chart showing a display control operation to be carried out in this case.

An instruction for printing on the medium TP is given and a medium type is detected by the medium type detecting sensor S4. If the medium is TP, the print is started. If the medium is not the TP, a standby mode is started to promote the change of the medium. The change of the medium by a user is detected through the reinsertion of the cassette and the medium type is detected again.

Figure 18:
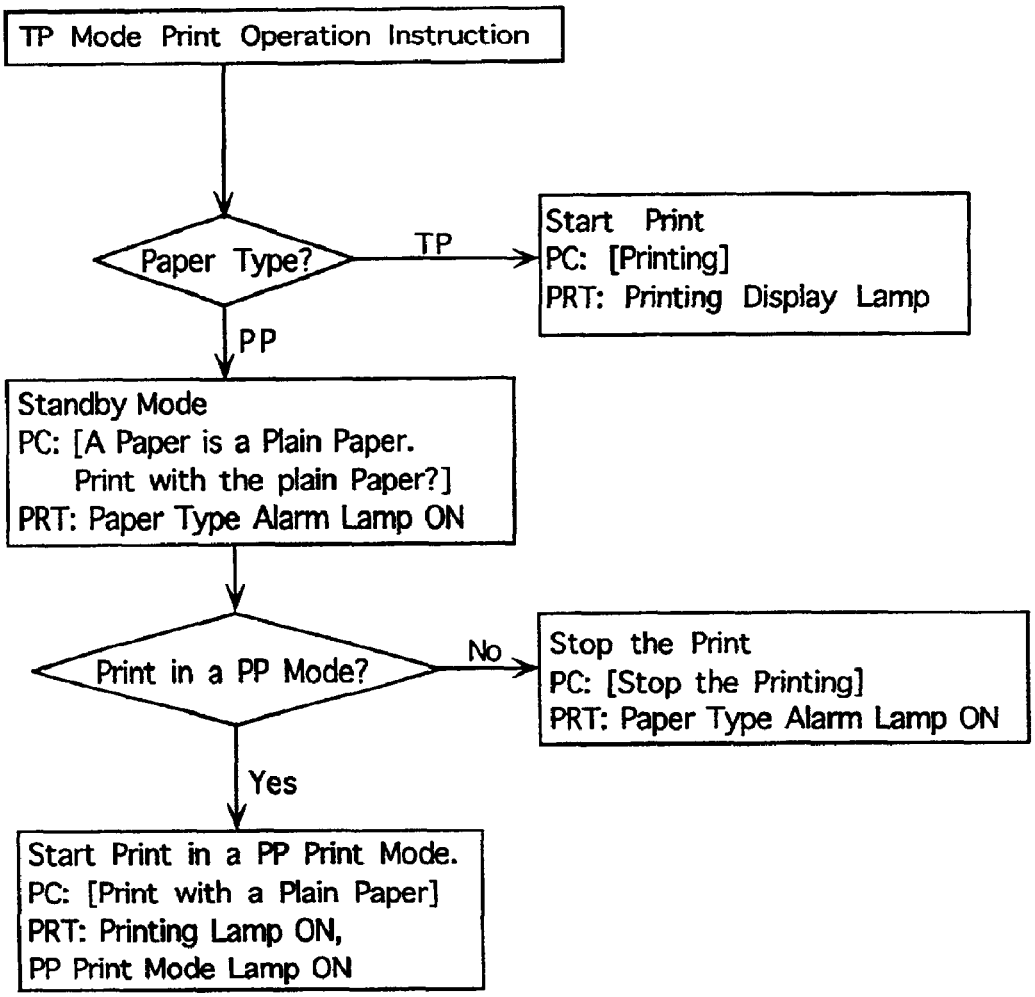
FIG. 18 is a flow chart showing a further example of the display control.

As shown in FIG. 18, however, the mode may be switched into the PP mode if the medium type is different.

EXAMPLE 8

For example, the apparatus PRT shown in FIG. 6 is used.

In this case, a user does not specify a print mode. The print mode is set in response to the automatic distinction of image data to be printed by the image forming apparatus driver (printer driver).

Figure 19:
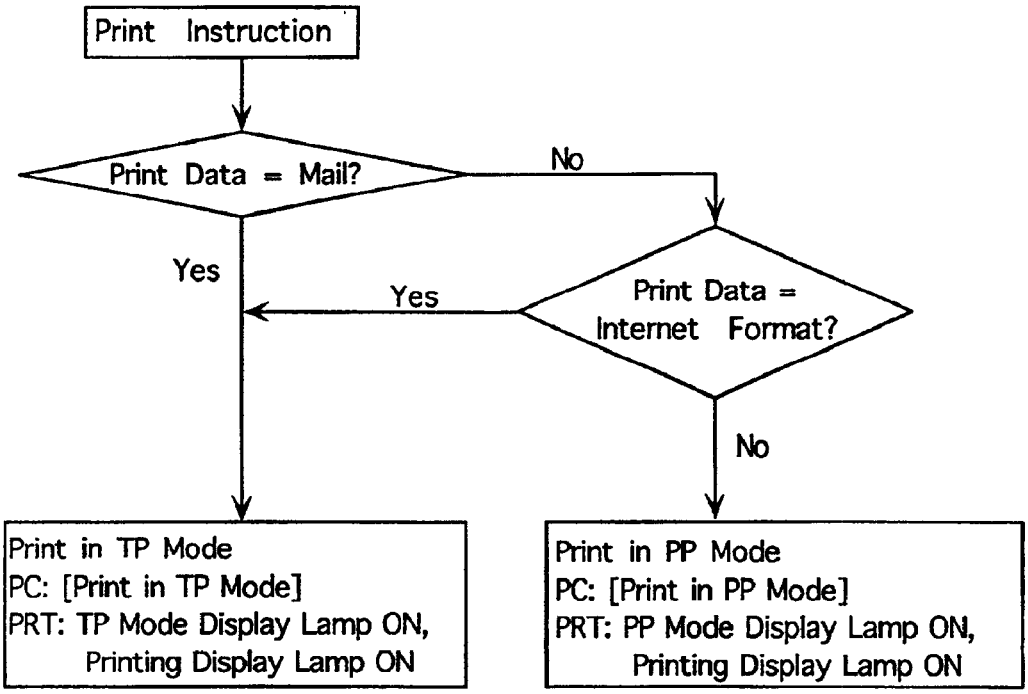
FIG. 19 is a flow chart showing a further example of the display control.

FIG. 19 is a flow chart showing a display control operation to be carried out in that case.

When the user does not specify the print mode but instructs printing, the printer driver detects the image data and first searches the presence of a mail header such as "From:", "To:" or "Message -ID:". As a result, when it is confirmed that the image data is mail data, the print is carried out in the TP mode. If the image data is not the mail data, a style peculiar to an html document such as "http" or "WWW" is then searched and it is determined whether the html document is present or not.

EXAMPLE 9

For example, the apparatus PRT shown in FIG. 6 is used.

In this case, a user does not specify the print mode. The print mode is set by a printer driver based on an application software receiving a print instruction or a print setting of an application software, thereby print is carried out.

Figure 20:
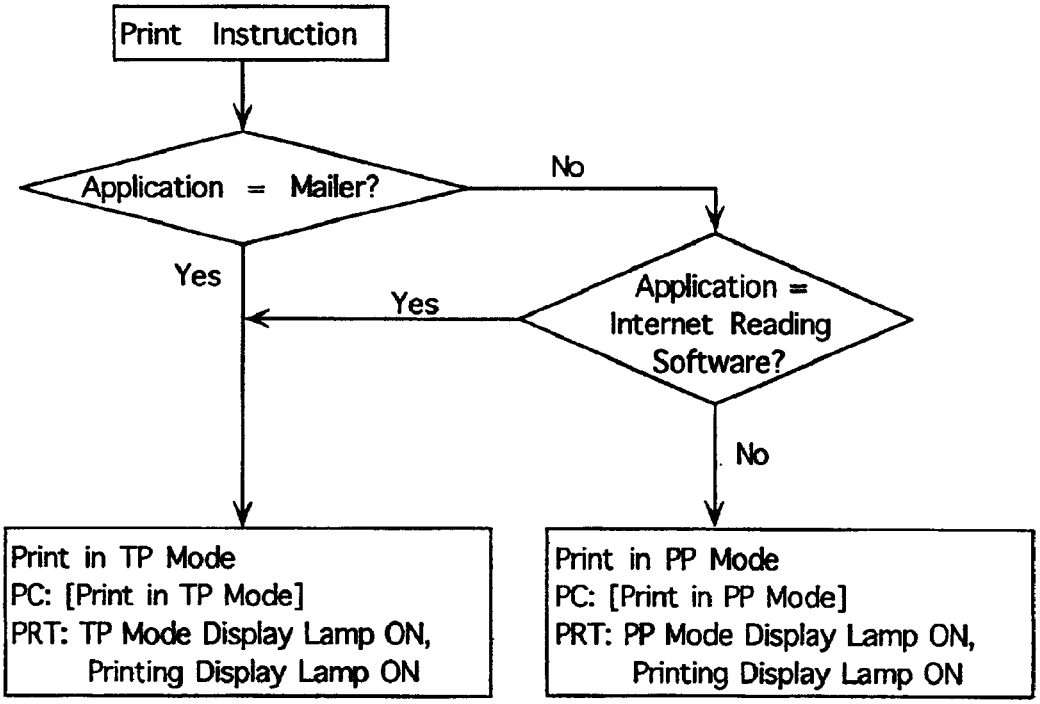
FIG. 20 is a flow chart showing a further example of the display control.

FIG. 20 is a flow chart showing a display control operation to be carried out in this case.

When the user does not specify the print mode but instructs the print, the printer driver detects the application software receiving the print instruction or the print setting of the application software. As a result, when the printer driver detects that the application sftware is a mailer or an html reading software, a display for printing in the TP mode is carried out and the print is performed in the TP mode. If not so, a display for printing in the PP mode is carried out and the print is performed in the PP mode.

EXAMPLE 10

In this case, a user does not specify a print mode. The print mode is set based on the result of detection of a type of the image information input apparatus which transmitted print image data.

Others are the same as those in the example 1.

Figure 21:
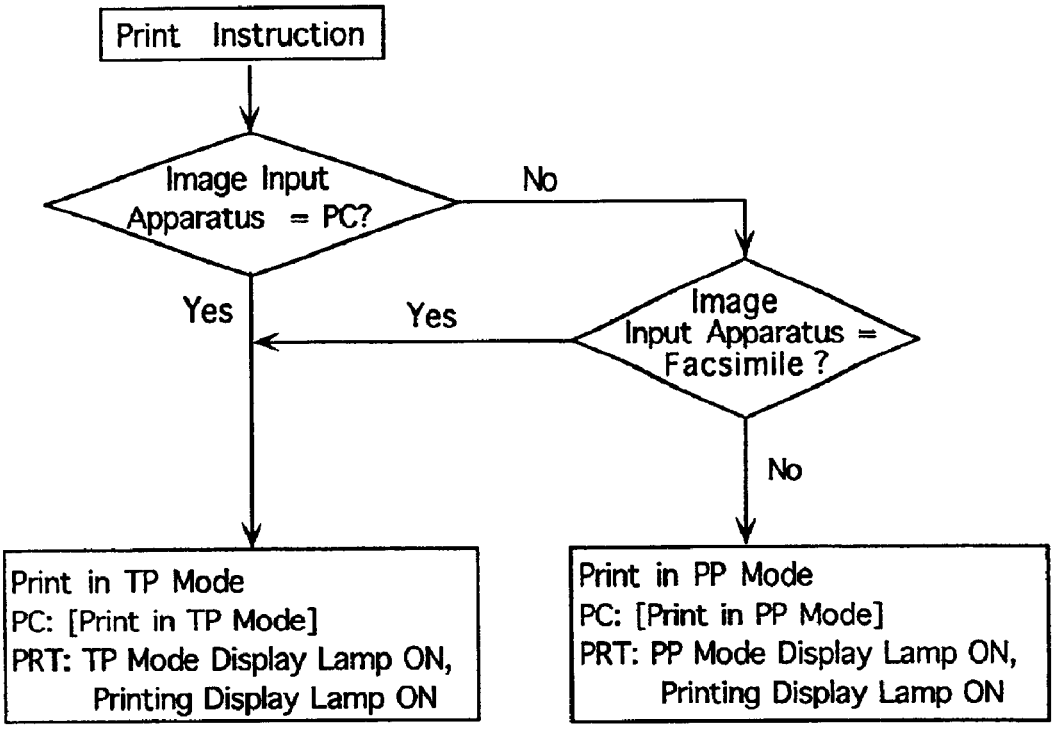
FIG. 21 is a flow chart showing a further example of the display control.

FIG. 21 is a flow chart showing a display control operation to be carried out in this case.

In FIG. 21, "PC" indicates a personal computer.

EXAMPLE 11

In this case, a user does not specify a print mode. A change history of data is detected. Others are the same as those in the example 1.

Figure 22:
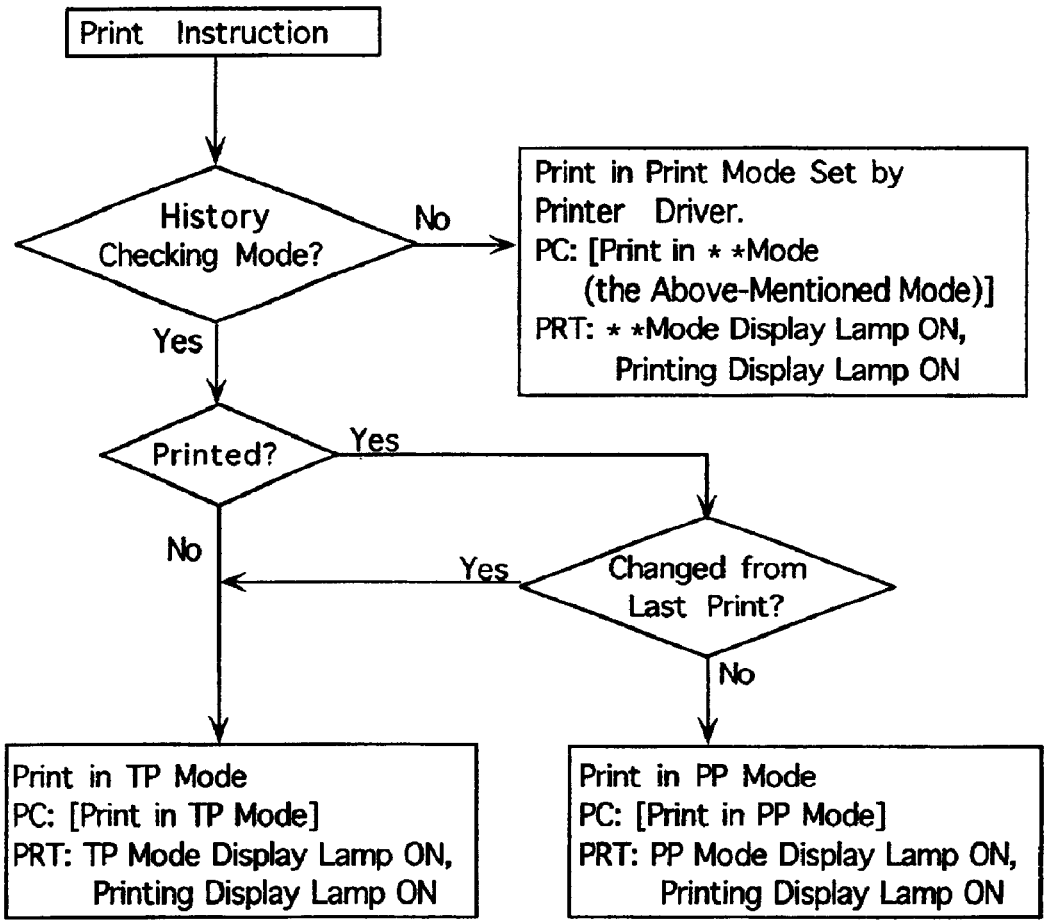
FIG. 22 is a flow chart showing a further example of the display control.

FIG. 22 is a flow chart showing a display control operation to be carried out in this case.

It is decided that a history checking mode is set or not. If the history checking mode is not set, print is carried out by using a medium decided by the medium setting (paper setting) of the printer driver. If the history checking mode is set, the change history of the image to be printed is checked. Only in the case in which the image has been printed and has not changed yet, the print is carried out in the PP mode and the display for the print in the PP mode is performed. In other cases, the print is carried out in the TP mode and the display for printing in the TP mode is performed.

An application software or a printer driver detects the presence of a changed history after the last print over a change history file. Alternatively, a key input carried out after the last printing may be monitored.

EXAMPLE 12

In this case, a paper jam is generated at the paper feeding cassette 1 (for a plain normal paper sheet) in the apparatus shown in FIG. 6, for example.

Figure 23:
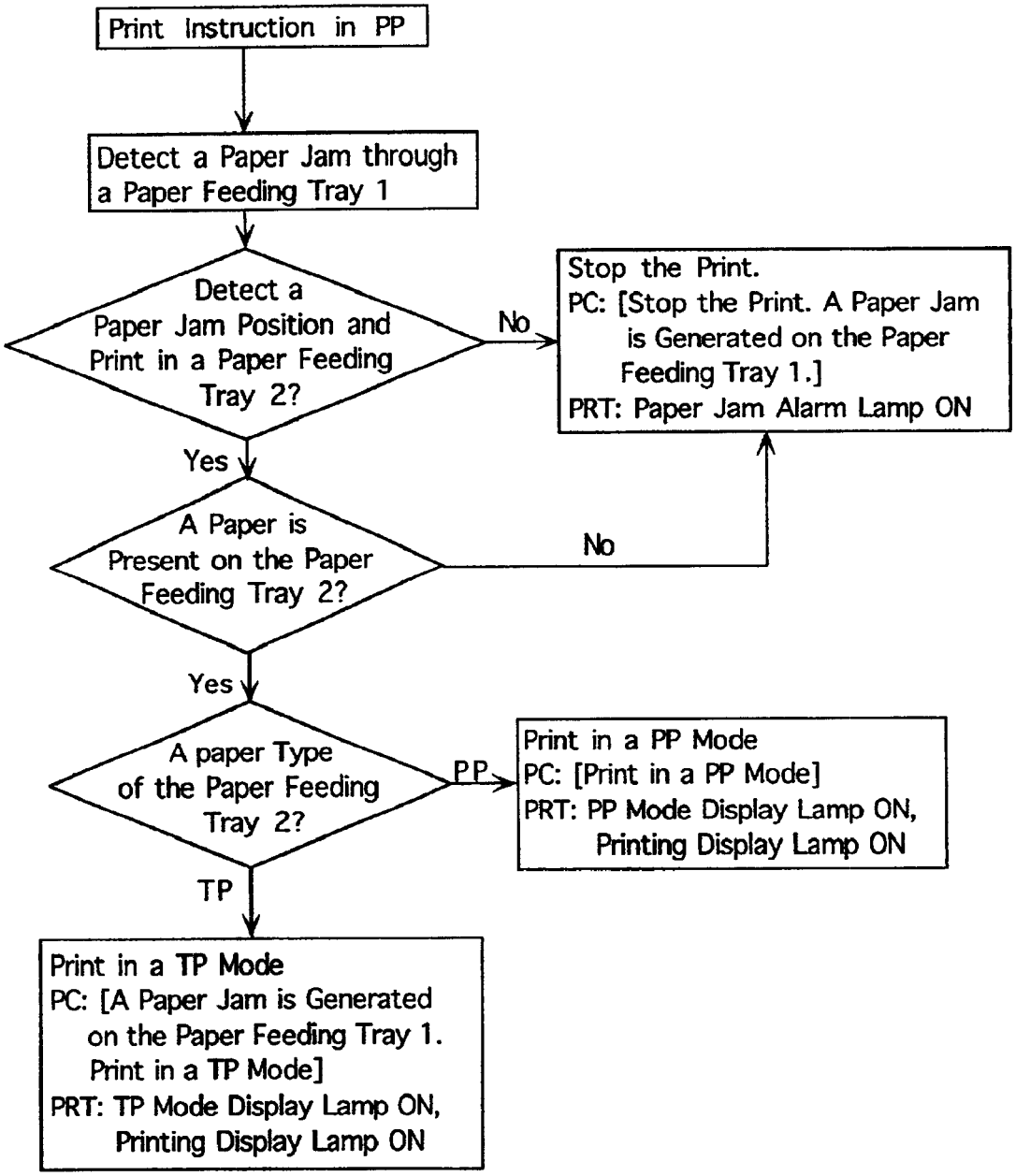
FIG. 23 is a flow chart showing a further example of the display control.

FIG. 23 is a flow chart showing a display control operation to be carried out in this case.

A position where the paper jam is generated is detected and it is decided that the print can be carried out by using the medium cassette 2 or not. If possible, the print is carried out. If impossible, a print stop is displayed to stop the print.

If a medium in the paper cassette 2 is the medium TP, the print is carried out in the TP mode. At the same time, the contents of an error and a processing are displayed on the apparatuses PC and PRT and the contents of the error are printed on the medium TP. If the paper feeding cassette 2 also accommodates the medium PP, the print is carried out in the PP mode and the contents of the error and the processing are displayed on the apparatuses PC and PRT.

EXAMPLE 13

The example 13 is the same as the example 2 except that a medium type is detected by test printing and others are detected.

Figure 24:
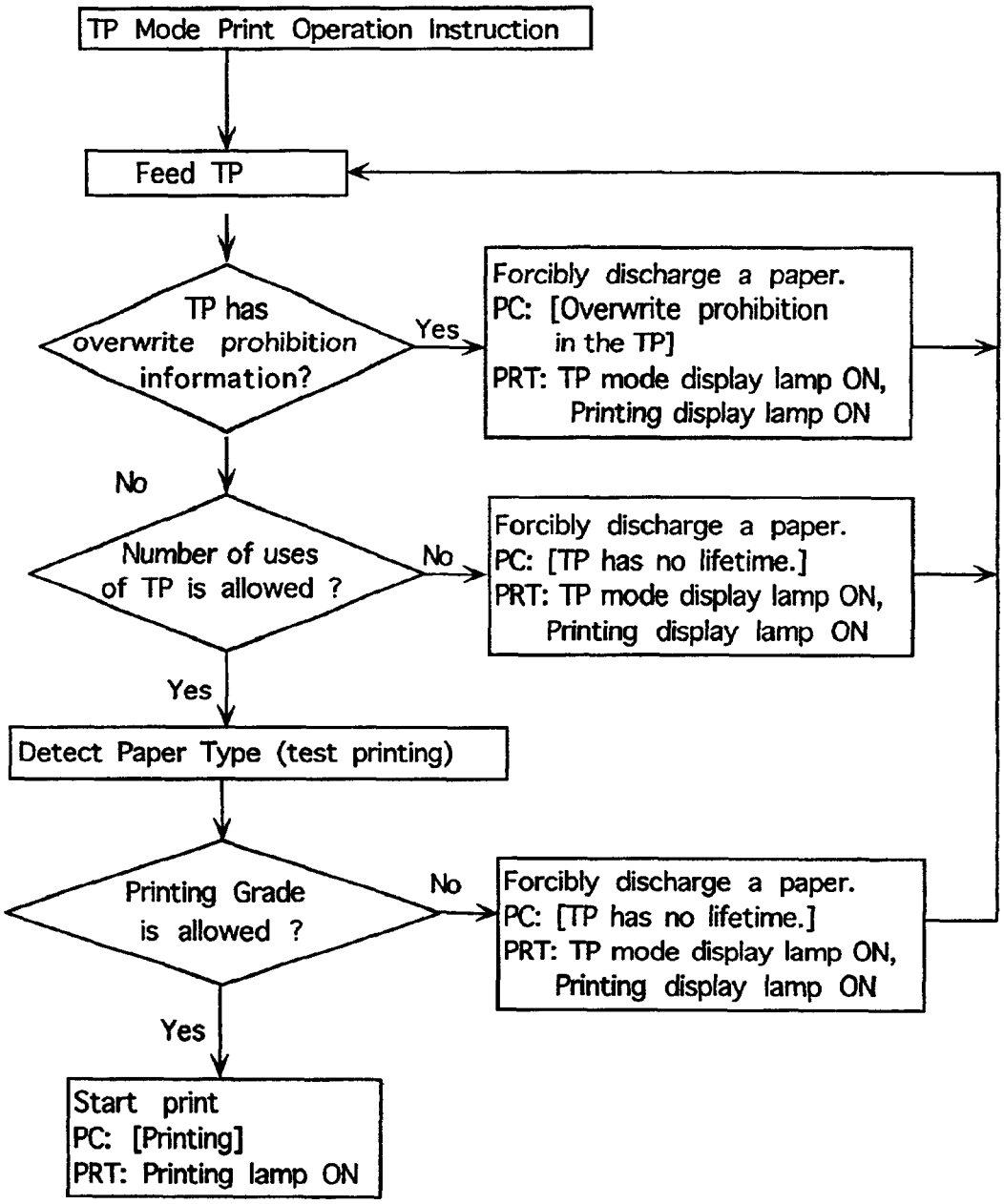
FIG. 24 is a flow chart showing a further example of the display control.

FIG. 24 is a flow chart showing a display control operation to be carried out in this case.

In this example, the medium TP/the medium PP is detected at the medium cassette, overwrite prohibition information is detected by an optical reflection density sensor, the number of uses of the medium TP is detected, and the lifetime of the medium TP is detected by test printing.

When a print instruction in the TP mode is received, the presence of the medium TP in the cassette is detected and the medium TP is supplied. Subsequently, the overwrite prohibition information indicated by a predetermined mark and the number of uses of the medium TP are detected by the optical density sensor. Then, test printing is carried out to detect the grade of the printing by an optical density sensor, thereby deciding whether or not a predetermined state is satisfied. If the predetermined state is satisfied, the print is carried out. On the other hand, if the results of the three detecting operations are not normal, a paper is forcibly discharged and the printing is carried out by using a next medium.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus comprising:

a first image forming portion for forming an image on a normal image display medium;

a second image forming portion for forming an image on a reversible image display medium;

a detecting device for detecting a state of a predetermined item in the image forming apparatus;

a device for outputting information about a state of the image forming apparatus in order to display at least part of the information about the state of the predetermined item in the image forming apparatus which is detected by the detecting device;

a device for outputting information about a setting state of the image forming apparatus in order to display at least part of the information about the setting state of the image forming apparatus for image information; and a display device for displaying a predetermined part of the information generated from the device for outputting the information about the state of the image forming apparatus and the device for outputting the information about the setting state of the image forming apparatus, wherein information about the state of the predetermined item in the image forming apparatus and information about a setting state of the image forming apparatus are output to the second image forming portion to be formed on the reversible image display medium.

2. The image forming apparatus according to claim 1, wherein the information is output on the reversible image display medium and to an image information input apparatus transmitting image data to display the information on a display device in the image information input apparatus.

3. The image forming apparatus according to claim 2, wherein the information output on the reversible image display medium includes at least one of number of uses, degree of deterioration and performance of the reversible image display medium.

4. The image forming apparatus according to claim 2, wherein the display of the information on the reversible image display medium are carried out by recording a code selected from a bar code and a two-dimensional code.

5. A method of displaying information about an image forming apparatus comprising a first image forming portion for forming an image on a normal image display medium and a second image forming portion for forming an image on a reversible image display medium and capable of forming an image on the normal image display medium by the first image forming portion and of forming an image on the reversible image display medium by the second image forming portion, wherein depending on the information, the information about the image forming apparatus is displayed on a display device in the image forming apparatus and a display device in an image information input apparatus transmitting image data to the image forming apparatus, and the reversible image display medium is a medium capable of displaying an image by applying an electric field corresponding to the image to be displayed to a contained and frictionally charged dry developer containing at least two kinds of frictionally chargeable dry developer particles having different chargeable polarities and having different reflection densities.

6. A method of displaying information about an image forming apparatus comprising a first image forming portion for forming an image on a normal image display medium and a second image forming portion for forming an image on a reversible image display medium and capable of forming an image on the normal image display medium by the first image forming portion and of forming an image on the reversible image display medium by the second image forming portion, wherein depending on the information, the information about the image forming apparatus is displayed on a display device in the image forming apparatus and a display device in an image information input apparatus transmitting image data to the image forming apparatus, and a type of the image display medium is detected, and the information about the image forming apparatus includes an information with respect to the type of the detected display-medium.

7. A method of displaying information about an image forming apparatus comprising a first image forming portion for forming an image on a normal image display medium and a second image forming portion for forming an image on a reversible image display medium and capable of forming an image on the normal image display medium by the first image forming portion and of forming an image on the reversible image display medium by the second image forming portion, wherein depending on the information, the information about the image forming apparatus is displayed on a display device in the image forming apparatus and a display device in an image information input apparatus transmitting image data to the image forming apparatus, and a direction of surface and back face of the reversible display medium is detected, and the information includes an information indicating that the back face of the reversible image display medium is detected.

8. The A method of displaying information about an image forming apparatus comprising a first image forming portion for forming an image on a normal image display medium and a second image forming portion for forming an image on a reversible image display medium and capable of forming an image on the normal image display medium by the first image forming portion and of forming an image on the reversible image display medium by the second image forming portion, wherein depending on the information, the information about the image forming apparatus is displayed on a display device in the image forming apparatus and a display device in an image information input apparatus transmitting image data to the image forming apparatus, and the information includes at least one of number of uses, degree of deterioration and performance of the-reversible image display medium to inform a lifetime of the reversible medium.

9. An image forming apparatus comprising:

a first image forming portion for forming an image on a normal image display medium;

a second image forming portion for forming an image on a reversible image display medium;

a detecting device for detecting a state of a predetermined item in the image forming apparatus;

a device for outputting information about a state of the image forming apparatus in order to display at least part of the information about the state of the predetermined item in the image forming apparatus which is detected by the detecting device;

a device for outputting information about a setting state of the image forming apparatus in order to display at least part of the information about the setting state of the image forming apparatus for image information; and a display device for displaying a predetermined part of the information generated from the device for outputting the information about the state of the image forming apparatus and the device for outputting the information about the setting state of the image forming apparatus, wherein information about the state of the predetermined item in the image forming apparatus is output to the second image forming portion to be formed on the reversible image display medium.

10. An image forming apparatus comprising:

a first image forming portion for forming an image on a normal image display medium;

a second image forming portion for forming an image on a reversible image display medium;

a detecting device for detecting a state of a predetermined item in the image forming apparatus;

a device for outputting information about a state of the image forming apparatus in order to display at least part of the information about the state of the predetermined item in the image forming apparatus which is detected by the detecting device;

a device for outputting information about a setting state of the image forming apparatus in order to display at least part of the information about the setting state of the image forming apparatus for image information; and a display device for displaying a predetermined part of the information generated from the device for outputting the information about the state of the image forming apparatus and the device for outputting the information about the setting state of the image forming apparatus, wherein information about the setting state of the image forming apparatus is output to the second image forming portion to be formed on the reversible image display medium.

11. An image forming apparatus comprising:

a first image forming portion for forming an image on a normal image display medium;

a second image forming portion for forming an image on a reversible image display medium;

a medium type detecting device for detecting that a medium to be used for image formation is the normal image display medium or the reversible image display medium;

a display device; and a controller, wherein when one of the normal image display medium and the reversible image display medium is designated by an image information input apparatus, the controller determines, based the medium detected by the medium type detecting device, whether image formation on the medium designated by the input apparatus can be normally carried out, and displays a message corresponding to the determination, on the display device and transmits an information corresponding to the determination to the input apparatus.

12. The image forming apparatus according to claim 11, wherein when the medium designated by the input apparatus is the reversible image display medium, and the controller determines, based on the medium detected by the medium type detecting device, that image formation on the reversible image display medium can not be carried out normally in the second image forming portion, the controller displays a message, corresponding to the determination on the display device and transmits an information corresponding to the determination to the input apparatus, and prohibits image formation.

13. The image forming apparatus according to claim 11, wherein when the medium designated by the input apparatus is the normal image display medium, and the controller determines, based on the medium detected by the medium type detecting device, that image formation on the normal image display medium can not be carried out normally in the first image forming portion, the controller displays a message corresponding to the determination on the display device and transmits an information corresponding to the determination to the input apparatus and prohibits image formation.

14. The image forming apparatus according to claim 11, wherein when the medium designated by the input apparatus is the reversible image display medium, and the controller determines, based on the medium detected by the medium type detecting device, that image formation on the reversible image display medium can not be carried out normally in the second image forming portion, the controller displays a message showing to a user that image formation can be carried out on the normal image display medium in the first image forming portion, and transmits an information corresponding to the determination to the input apparatus.

15. The image forming apparatus according to claim 11, wherein when the medium designated by the input apparatus is the normal image display medium, and the controller determines, based on the medium detected by the medium type detecting device, that image formation on the normal image display medium can not be carried out normally in the first image forming portion, the controller displays a message showing to a user that image formation can be carried out on the reversible image display medium in the second image forming portion, and transmits an information corresponding to the determination to the input apparatus.

16. The image forming apparatus according to claim 11, wherein when one of the normal image display medium and the reversible image display medium is designated by the image information input apparatus, and the controller determines, based on the medium detected by the medium type detecting device, that image formation on the designated image display medium can not be carried out normally, the controller displays a message corresponding to the determination on the display device and transmits an information corresponding to the determination to the input apparatus, and changes to the image forming portion to be used for image formation to allow to form an image on the image display medium other than the designated image display medium.

17. An image forming apparatus comprising:

a first image forming portion including an image fixing device for forming an image on a normal image display medium;

a temperature detecting sensor for detecting a temperature of the fixing device;

a second image forming portion for forming an image on a reversible image display medium;

a medium type detecting device for detecting that a medium to be used for image formation is the normal image display medium or the reversible image display medium;

a display device; and a controller;

wherein when an image formation instruction is inputted from an image information apparatus, the controller determines, based on the medium detected by the medium type detecting device and the temperature detected by the temperature detecting sensor, whether image formation on the medium designated by the input apparatus can be normally carried out, and displays a message corresponding to the determination on the display device and transmits an information corresponding to the determination to the input apparatus.

* * * * *